US007077770B2

(12) United States Patent
Palomaki et al.

(10) Patent No.: US 7,077,770 B2
(45) Date of Patent: Jul. 18, 2006

(54) ARROW SYSTEM

(75) Inventors: Teddy D. Palomaki, Park City, UT (US); Edwin A. Rowsell, South Jordan, UT (US)

(73) Assignee: Jas. D. Easton, Inc., Van Nuys, CA (US)

( * ) Notice: Subject to any disclaimer, the term of this patent is extended or adjusted under 35 U.S.C. 154(b) by 0 days.

(21) Appl. No.: 10/886,285

(22) Filed: Jul. 7, 2004

(65) Prior Publication Data

US 2005/0072413 A1 Apr. 7, 2005

Related U.S. Application Data

(63) Continuation-in-part of application No. 10/678,821, filed on Oct. 3, 2003.

(51) Int. Cl.
*F42B 6/04* (2006.01)

(52) U.S. Cl. ..... 473/578; 473/582

(58) Field of Classification Search ..... 473/578, 473/582, 583

See application file for complete search history.

(56) References Cited

U.S. PATENT DOCUMENTS

| | | | | |
|---|---|---|---|---|
| 4,203,601 | A | 5/1980 | Simo | 273/421 |
| 4,533,146 | A | 8/1985 | Schaar | 273/422 |
| 4,706,965 | A | 11/1987 | Schaar | 273/416 |
| 5,035,764 | A | 7/1991 | Blake | 156/327 |
| 5,090,149 | A | 2/1992 | Muk Kim | 43/18.1 |
| 5,242,720 | A | 9/1993 | Blake | 428/34.5 |
| 5,273,293 | A | 12/1993 | Lekavich | 273/416 |
| 5,465,979 | A | 11/1995 | Buhler | 273/416 |
| 5,496,042 | A | 3/1996 | Craft et al. | 273/421 |
| 5,516,117 | A * | 5/1996 | Rangel | 473/578 |
| 5,921,875 | A | 7/1999 | Bickel | |
| 6,017,284 | A | 1/2000 | Giles | |
| 6,241,634 | B1 | 6/2001 | Armer, Jr. | 473/581 |
| 6,251,036 | B1 | 6/2001 | Wu et al. | 473/578 |
| 6,274,230 | B1 | 8/2001 | Sarrelongue | 428/293.7 |
| 6,520,876 | B1 | 2/2003 | Eastman, II | 473/578 |
| 6,554,726 | B1 | 4/2003 | Thurber | 473/578 |
| 6,932,728 | B1 | 8/2005 | Palomaki | |
| 2003/0013565 | A1 | 1/2003 | Song | 473/578 |
| 2003/0073524 | A1 | 4/2003 | Song | 473/578 |
| 2003/0104884 | A1 | 6/2003 | Eastman, II | 473/578 |

OTHER PUBLICATIONS

Beman Products Catalog, 1999.
Game Tracker Catalog, 1998.
Advertisement for Easton P/C All-Carbon Hunting Shaft, date unknown.

* cited by examiner

*Primary Examiner*—John A. Ricci
(74) *Attorney, Agent, or Firm*—Holland & Hart

(57) ABSTRACT

The invention is directed to an arrow system having a shaft having a first end and an insert receptive of a standard point, the insert being disposed completely within the first end of the shaft. An insert installation tool may be used as part of the invention to facilitate insertion of the insert into the first end of the shaft. The invention further includes a reduced diameter hunting arrow shaft that maintains sufficient spine and weight characteristics. The reduced diameter hunting arrow shaft is receptive of standard or non-standard internal components for increasing arrow penetration and shot accuracy. Still further, the invention includes an arrow tip assembly including a male insert and a female point to assist in aligning points with arrow shafts. The arrow shaft is in one embodiment an aluminum-carbon arrow which includes a metallic core and an outer fiber reinforced polymer layer.

11 Claims, 18 Drawing Sheets

ARROW SYSTEM

RELATED APPLICATIONS

This is a continuation-in-part of U.S. application Ser. No. 10/678,821 filed Oct. 3, 2003.

TECHNICAL FIELD

This invention relates to arrow systems, including in particular hunting arrow systems.

BACKGROUND OF THE INVENTION

Many different types of arrows and arrow shafts are known for use in hunting and sport archery. Two arrow types of relatively recent design are the fiber reinforced polymer (FRP) arrows and the aluminum arrows wrapped with fiber reinforced polymer. FRP is a generic term including, but not limited to, fiberglass composites and carbon fiber composites. Aluminum arrow shafts covered with fiber reinforced polymer are usually made of an aluminum core covered with carbon fiber and are often referred to as aluminum carbon composite (ACC) arrows, although any fiber reinforced polymer may be used as the covering. Traditional FRP and ACC shafts have been produced by a number of different manufacturing processes. The first FRP arrow shafts were constructed with unidirectional reinforcing fibers aligned parallel to the axis of the shaft.

Prior designs and processes for constructing FRP shafts resulted in a low circumferential or hoop strength. The hoop strength of these arrow shafts was so low that the arrows could not withstand even small internal loads applied in a direction radially outwardly from the center of the shaft. For example, internal loads generated from inserting standard components into the inside of these types of shafts would have resulted in failure of the arrow shaft. Standard arrow components, such as those shown in FIG. 1, include inserts 100, points 116 ("point" as used herein means any structure formed at or secured to the forward or distal end of the arrow, including without limitation field points, broadheads, etc.), and nocks 102, all of which are mounted to an arrow shaft 104. It should be noted that fletching, required for proper arrow flight, is not shown in the drawings, but is well understood by those skilled in the art.

Because insert components have not been practical for use with the relatively small diameter FRP prior art shafts of types discussed above, externally attached components have been developed and used. FIG. 2 illustrates two such external components, known as "outserts" in the industry. The term "outsert," as it suggests, refers to an arrow component that is inserted or installed over the outside diameter of the arrow. The two outserts shown in FIG. 2 include an outsert receptacle 200 to receive a point 116 and an outsert nock 202. Outserts were, at the time, the only viable way to attach the various other arrow components to these prior FRP shafts because of their low hoop stress. Arrow shaft outserts have, however, at least three key disadvantages. First, outsert nocks 202 have a feel that is objectionable to most archers. Generally, archers prefer a smooth outer surface of the shaft without any projections (other than the fletching). This smooth outside diameter preference correlates with the general understanding that an arrow will have better aerodynamic efficiency with fewer structural projections outside of the arrow shaft.

Second, outsert nocks 202 frequently result in mechanical interference with many types of arrow rests when launching the arrow. Most arrow rests hold the arrow in a particular position when the archery bow is drawn and the arrow is released. With many arrow rests, the arrow continues to contact the arrow rest as the arrow passes the location of the arrow rest. Contact between the nock outsert and the arrow rest can result in unpredictable disturbances during launch of the arrow, and therefore will affect the accuracy of the shot.

Third, the point outsert 200 has a larger diameter relative to the diameter of the shaft, which makes the arrows containing the point outsert 200 more difficult to extract from various targets as compared to arrows with insert components only. Use of the point outsert 200 often results in damaged points and outserts 200, and further causes points and outserts 200 to detach from the arrow shaft and remain inside the target after the arrow is pulled from the target. Points and/or outserts 200 lost inside a target may cause damage to subsequent arrows that happen to impact the target at the same location as the lost points or outserts. As a result, some commercial archery ranges have banned outsert-equipped arrow shafts.

In an apparent attempt to address the limitations described above, modern FRP arrows with new types of construction have been developed. The typical modern FRP arrows include glass and/or carbon fibers arranged in multiple directions, as opposed to the unidirectional fiber arrangement of the earlier FRP arrows. The multi-directional fiber arrangement (e.g., fibers that run perpendicularly or at an angle relative to each other) increases the hoop strength of the shafts, which allows the shafts to support greater internal loads, including internal loads generated by insert components. Such modern FRP arrows have, however, been traditionally made having an outside diameter and wall thickness of a size sufficient to accommodate standard-sized inserts. These carbon-composite arrows were generally lighter than aluminum shafts, but were generally of the same spine. "Spine" is an industry-standard measurement of arrow shaft stiffness. Spine is measured according the parameters shown in FIG. 3. As shown, a shaft 304 is supported at two points 306 and 308, which are separated by a distance of 28 inches. A 1.94-pound weight is applied at a mid point 310 of the shaft 304. The deflection 312 of the shaft 304 relative to the horizontal is defined as the "spine." An arrow must have certain spine characteristics, depending on its length and the draw weight of the archery bow, to achieve proper flight. Generally, the heavier the draw weight, the stiffer the spine (i.e., less deflection) must be. ACC shafts are also generally lighter than standard aluminum arrows of the same spine because they comprise a thin, light core wound with carbon composites.

As a major portion of the archery market has moved toward lighter weight shafts, the modern FRP and ACC arrow have gained widespread acceptance. Lighter arrow shafts have the principal advantage of higher velocities when launched from the same bow. Such higher velocities result in a flatter arrow trajectory. The practical advantage of flatter trajectory is that a misjudgment by an archer of the range to a target has less effect on the point of impact.

Due to material and structural considerations, however, in designing internal-component FRP and ACC arrow shafts for reduced weight, it became necessary to both increase shaft outside diameter and reduce wall thickness relative to the prior art FRP and ACC outsert shafts in order to provide desirable spine/weight combinations. For aluminum arrow shafts, for example, to provide lighter weight arrows, the wall thickness must be reduced and the diameter of the arrow, both the inside diameter and the outside diameter, must be increased to maintain adequate spine. This process of thinning the wall and increasing shaft diameter has, however, practical limitations. At some point, if taken to an illogical extreme, the arrow would have mechanical properties similar to an aluminum beverage can with no practical resistance to side loads or crushing.

With some arrows, inserts, such as "half-out" inserts, were introduced to the market some time ago. A typical half-out insert assembly is shown in FIG. 4A. A half-out insert 400 includes a first insert portion 412 with a diameter smaller than the standard insert 100 shown in FIG. 1 such that the first insert portion 412 may be inserted into a reduced diameter shaft 404. A second portion 414 of the half-out insert 400 has a larger outside diameter that is receptive of a standard point 416, yet its outside diameter corresponds to the outside diameter of shaft 404. Therefore, half-out inserts facilitate use of standard field points with arrow shafts having inside diameters smaller than standard arrow shafts.

Half-out assemblies have, however, several disadvantages and have not been well accepted. Half-out assemblies are cantilevered at the front of the arrow shaft 404. The cantilever results in a system that tends to deform more readily on impact as compared to other arrow assemblies. The half-out assemblies also make it more difficult to precisely align points 416 with the shaft 404, as will be discussed below in greater detail.

SUMMARY OF THE INVENTION

The present invention comprises an arrow including a shaft with a first end and an insert receptive of a point, the insert being disposed completely within the first end of the shaft. Hunters commonly use field points for practice and broadheads (either expandable or fixed-blade) for hunting. Although this aspect of the present invention (i.e., an internal component small outside diameter arrow shaft and a novel insert installation system) is advantageous when field points are used, the invention is particularly advantageous when using broadheads because broadheads exacerbate many shaft/insert/point alignment problems.

According to one embodiment, the point may include a shoulder and the shaft may include an end wall. The insert is seated at a depth within the shaft such that the shoulder of the point bears directly against the end wall of the shaft when the point is engaged with the insert. In one embodiment, the shaft may have an inside diameter of approximately 0.204 inches, a spine of approximately 0.500 inches or less, and an outside diameter less than 0.275 inches. When spine is discussed herein, "stiffer" spine means less arrow deflection (i.e., a smaller numeric value), and "weaker" spine means greater arrow deflection (i.e., a larger numeric value). Thus, the terms "less spine" and "stiffer spine" have the same meaning throughout. In a similar manner, the terms "more spine" and "weaker spine" have the same meaning throughout.

Another embodiment comprises an arrow including a shaft having an inside diameter, a first end, and a first end wall, and a point having a head, a shoulder, and a shank, where the shoulder of the point bears directly against the first end wall and the shank fits snugly inside the arrow shaft and bears against the inside surface of the arrow shaft. The direct contact between the point and arrow shaft improves alignment between these two components. In this embodiment, the insert is disposed completely inside the shaft and the point is threadedly received by the insert.

Still another embodiment comprises a reduced diameter carbon-composite hunting arrow shaft including an inside diameter of approximately 0.204 inches, a spine of approximately 0.500 inches or less, and an outside diameter less than approximately 0.275 inches. In this embodiment, an insert may be disposed completely within the shaft and a point coupled to the insert.

Yet another embodiment comprises a hunting arrow including a hollow shaft having an inside diameter sized to accept standard points, an outside diameter of less than 0.275 inches, and a spine of 0.500 inches or less. This embodiment may include an insert embedded completely within the shaft and a point coupled to the insert.

Another embodiment comprises a reduced diameter FRP hunting arrow shaft including an inside diameter of approximately 0.204 inches, a spine of approximately 0.500 inches or less, and an outside diameter of 0.275 inches or less. The inside diameter of about 0.204 is receptive of standard point inserts.

Another embodiment of the invention comprises an arrow including a shaft with a first end, a male insert disposed partially within the first end and extending beyond the first end, and a female point having a flange or skirt that extends over the arrow shaft in a tight-fitting manner to assist in alignment of the point with the arrow shaft.

Still another embodiment comprises a reduced diameter FRP hunting arrow shaft including an inside diameter of approximately 0.200 inches, a spine of approximately 0.500 inches or less. The outside diameter may range between approximately 0.255 and 0.271 inches. The inside diameter of about 0.200 is receptive of standard half-out inserts.

Another embodiment comprises a reduced diameter FRP hunting arrow shaft, including an inside diameter less than 0.200 inches, a spine of 0.500 inches or less, and an outside diameter of 0.275 inches or less. The inside diameter may be approximately 0.187 inches.

Another embodiment comprises a point assembly including a male insert having a first end configured to engage an arrow shaft and a second end, and a female point configured to mate with the second end of the male insert. The male insert may include a tapered head between the first and second ends, and the female point may include an interior tapered surface shaped to mate with the tapered head of the male insert.

Yet another embodiment of the invention comprises an arrow including a shaft with a first end, a male insert disposed partially within the first end and extending beyond the first end, and a female point engaged with the male insert.

Still another embodiment comprises an insert installation tool including a positioning rod, where the rod includes a first end, a second end, a first diameter at the first end sized smaller than an inside diameter of an insert, one or more lips disposed between the first and second ends, the one or more lips having a diameter sized to provide an interference fit with an inside diameter of an arrow shaft, and a shoulder disposed between the first end and the one or more lips sized larger than the inside diameter of the insert; where the first end of the rod is configured to engage the point insert. The installation tool is designed to position the insert at a desired depth inside the arrow shaft.

Another aspect of the invention involves a method of coupling a point to an arrow shaft including inserting an entire point insert into the arrow shaft and fastening the point to the point insert. According to this method, the point includes a shoulder and a shank, where the shoulder directly engages an end wall of the arrow shaft and the shank directly engages the inside surface of the arrow shaft, all of which assists with point alignment.

Another aspect of the invention involves a method of coupling a point to an arrow shaft including installing a point insert onto the installation tool and pressing the point insert into the shaft with the tool to a predetermined depth such that a first end of the point inserted is flush with or interior to a first end of the shaft. The insert installation tool may include a grip with a diameter larger than an outside diameter the arrow shaft or another similar end wall that limits the extent to which the point insert can be pushed inside of the arrow shaft.

Yet another aspect of the invention involves a method of improving alignment between an arrow point and an arrow shaft by embedding an insert completely within the shaft and coupling the arrow point to the insert, where the arrow point and the shaft directly interface between each other at a first location where a shoulder of the point and an end surface of the shaft contact each other and at a second location where the shank of the point and the inside diameter of the shaft contact each other. Embedding the insert may include extending the insert to a predetermined depth within the shaft.

Still another embodiment of the invention comprises an arrow including a shaft with a first end defining a first end wall, an insert with a first end defining a first end wall, the insert being disposed inside the shaft such that the first end wall of the insert is flush with or interior to the first end wall of the shaft.

In another embodiment, an arrow system includes an insert of substantially constant outside diameter such that the insert is fully insertable into an arrow shaft, the insert including a threaded portion, and a point including a threaded portion engagable with the threaded portion of the insert.

Another aspect of the invention involves an arrow preparation tool comprising an abrasive material to engage an end wall of an arrow shaft and a protuberance extending from the abrasive material, where the protuberance is sized to interface with an inside surface of the arrow shaft such that rotation of the arrow shaft relative to the abrasive material will cause a chamfer to form between the inside surface of the arrow shaft and the end wall of the arrow shaft.

Still another aspect of the present invention involves an internal fit component FRP hunting arrow shaft comprising an arrow shaft to receive internal fit components, where the arrow shaft has a weight in proportion to twenty-nine inches of arrow shaft, and wherein the weight or the spine falls on a plot of weight versus spine above and to the left of a straight line that includes a first point having a weight of 190 grains and an outside diameter of 0.275 inches, and a second point having a weight of 320 grains and an outside diameter of 0.305 inches.

Another aspect of the present invention involves an internal fit component FRP hunting arrow shaft comprising an arrow shaft to receive internal fit components, wherein the arrow shaft spine or the outside diameter of the arrow shaft falls on a plot of spine versus outside diameter below and to the left of a straight line that includes a first point having a spine of 0.320 inches and an outside diameter of 0.295 inches, and a second point having a spine of 0.480 inches and an outside diameter of 0.280 inches.

Another aspect of the present invention involves an arrow shaft comprising a metallic core having a front end portion, a fiber reinforced polymer layer disposed about the metallic core, and an insert receptive of a point disposed completely within the front end portion of the shaft. The point may comprise a shoulder and the shaft comprises a front end wall. The insert may be seated at a depth within the shaft such that the shoulder of the point bears against the front end wall of the shaft when the point is fully engaged with the insert. An outer diameter of the fiber reinforced polymer layer may comprise a standard aluminum arrow size, or be less than or equal to approximately 0.275 inches. An inner diameter of the metallic core may be approximately 0.200 inches. The metallic core may comprise an aluminum tube, and the fiber reinforced polymer layer may comprise carbon.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

Figure 1:
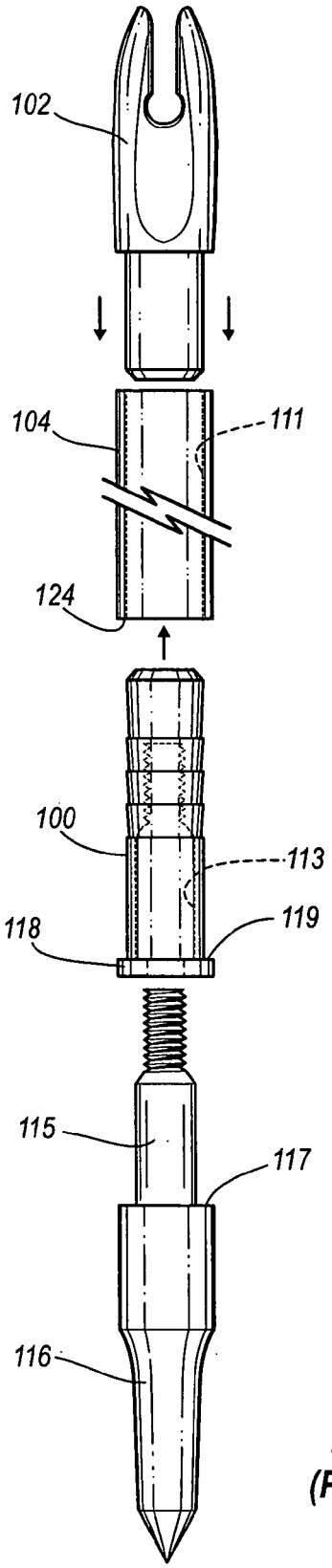
Fig. 1 (Prior Art)
FIG. 1 is a side view of an FRP arrow utilizing inserts according to the prior art.
Figure 2:
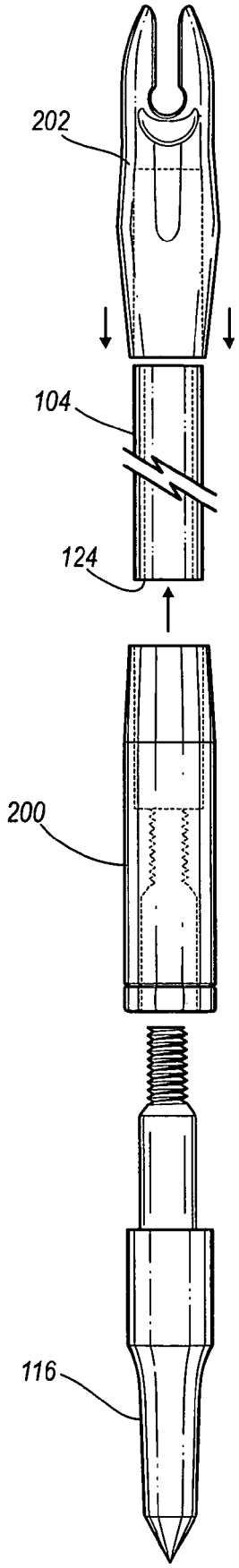
Fig. 2 (Prior Art)
FIG. 2 is a side view of an FRP arrow utilizing outserts according to the prior art.
Figure 3:
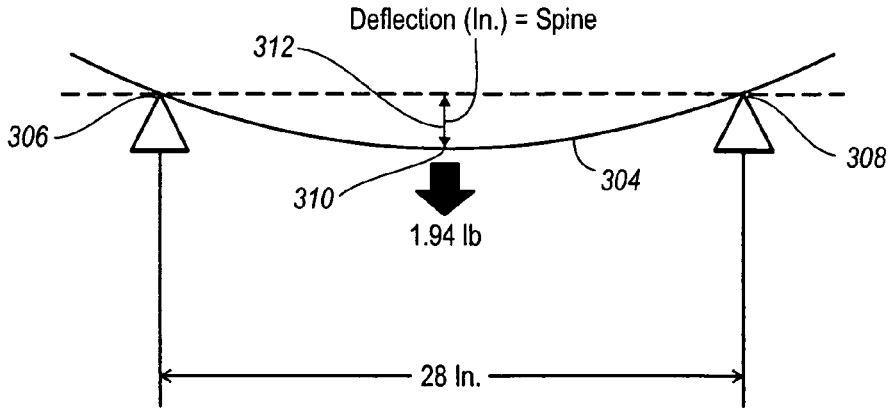
Fig. 3 (Prior Art)
FIG. 3 is a diagram illustrating spine measurement parameters.

The present specification describes a novel arrow system that may be used for archery, and particularly for bowhunting. One aspect of the novel arrow system relates to a reduced diameter hunting arrow. The reduction in diameter of a hunting arrow facilitates more accurate shooting and better penetration than previous arrows. The reduced diameter hunting arrow may be sized to accommodate standard arrow point assemblies, half-out arrow point assemblies, or smaller diameter arrow point assemblies. The reduced diameter hunting arrow may also be used to accommodate a new point insert system and a new arrow point assembly, both of which are further described below. The novel arrow system also involves an insert installation tool to facilitate placement of the novel insert into an arrow shaft and an arrow shaft preparation tool to ensure the shaft will properly accommodate a point.

Accordingly, the specification describes various aspects of the invention according to the following order. First, embodiments of an arrow utilizing the new point inserts are shown and described, along with the arrow point assembly tool. Second, experimental data illustrating the advantages of a reduced diameter arrow is discussed. Third, various embodiments of reduced diameter arrow shafts are described. Fourth, various embodiments relative to the new arrow system and assembly method for reduced diameter arrows are shown and described.

As used in this specification and the appended claims, the phrases "completely within" or "completely inside" mean that an item is located interior to an object and does not protrude or extend from the object. "Completely within" and "completely inside" also include arrangements in which the item is located interior to and flush with the object.

The term "insert" is used broadly to encompass any apparatus that is or may be at least partially introduced into or inside an arrow shaft.

"Hunting arrow" is also used broadly to include any arrows, parts of arrows, or arrow assemblies that are intended specifically for hunting.

"Fiber reinforced polymer (FRP)" refers to any combination of materials of which carbon is one, including without limitation fiber reinforced materials, advanced composites, and other material sets that include only carbon.

"Spine" is used to indicate a stiffness measurement according to the standard parameters described above, as understood by those skilled in the art.

"Point" as used to describe the present invention shall mean, for purposes of simplifying the description, any type of arrow point, including without limitation field points and broadheads.

"Internal insert components" means inserts that fit inside of an arrow shaft as well as any type of arrow point received by such inserts.

As mentioned above, a number of developments in arrow technology, and particularly hunting arrow technology, have recently occurred. While there are many different types of arrows available, conventional arrows have traditionally not provided the combination of accuracy, flat trajectory, short travel time, penetration and internal fit components offered by a reduced diameter hunting arrow shaft according to the present invention. The methods and devices described herein include various reduced diameter arrow shafts and other associated devices. The particular implementations, however, are exemplary in nature, and not limiting.

Figure 5A:
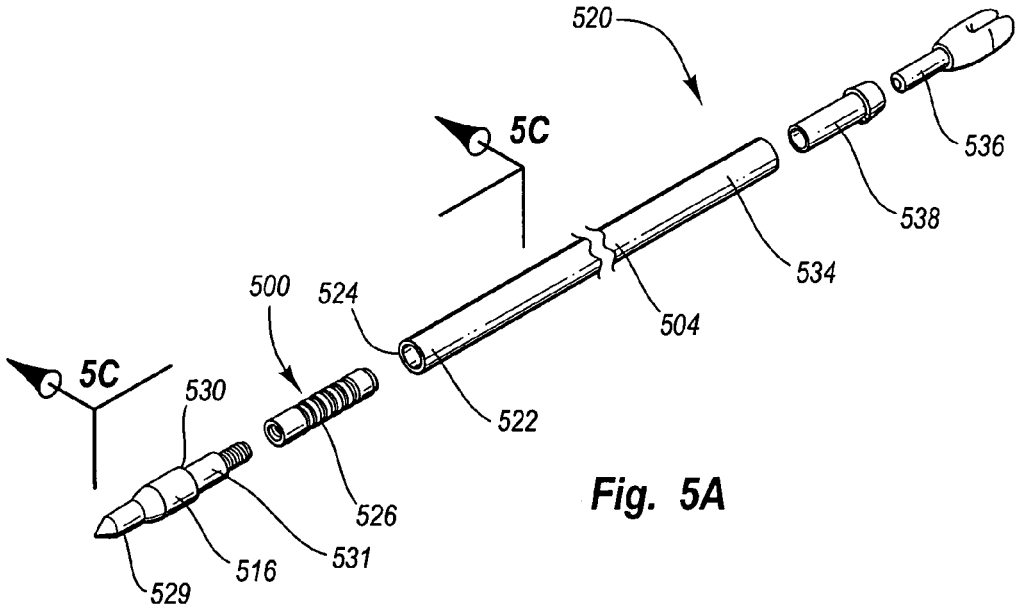
FIG. 5A is an exploded perspective assembly view of an arrow according to one embodiment of the present invention.
Figure 5B:
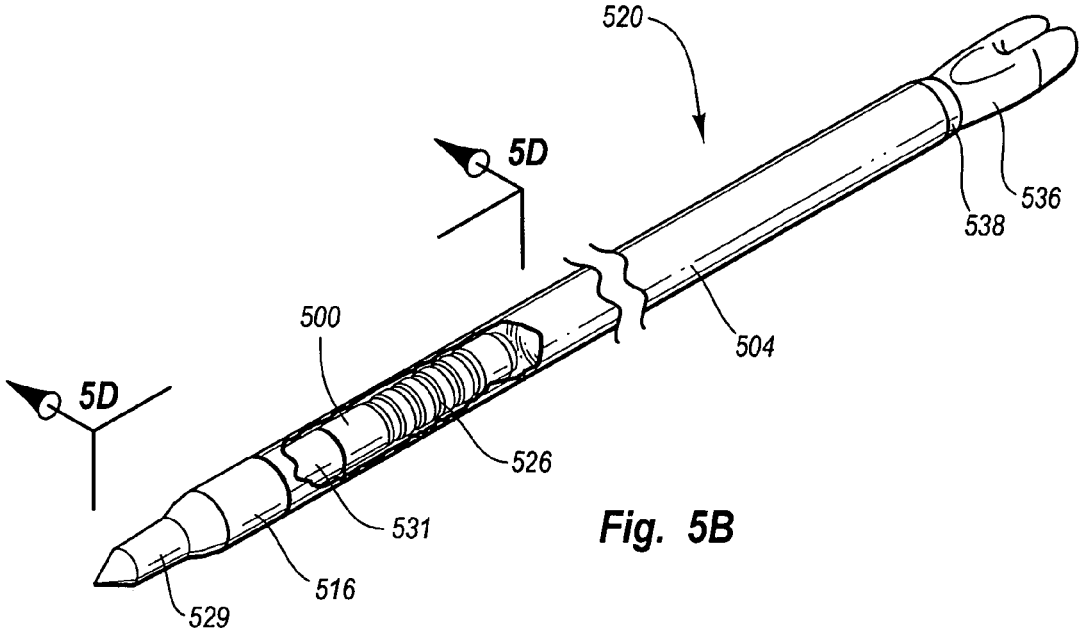
FIG. 5B is an assembled perspective view of the arrow shown in FIG. 5A.
Figure 5C:
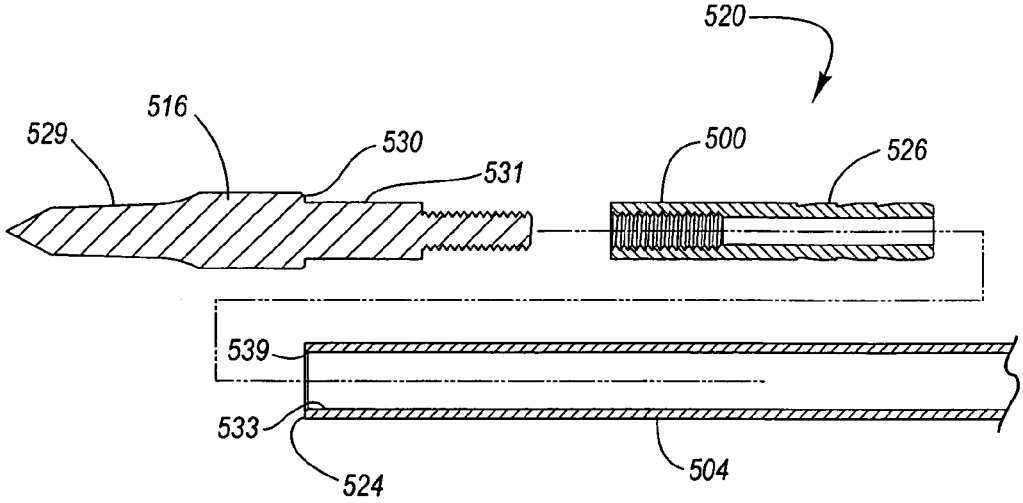
FIG. 5C is an exploded partial sectional side elevation view of an end of the arrow shown in FIG. 5A.
Figure 5D:
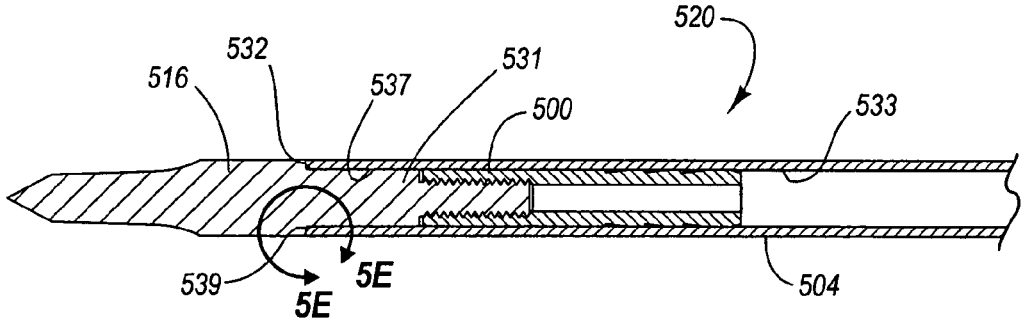
FIG. 5D is a partial sectional side elevation view of the end of the arrow as shown in FIG. 5B.

Turning now to the figures, and in particular to FIGS. 5A–E, a hunting arrow 520 according to one embodiment of the present invention is shown. According to FIGS. 5A–E, the hunting arrow 520 includes a shaft 504 and an insert 500. The insert 500 is receptive of a point 516. The insert 500 is advantageously sized to fit snugly completely within the shaft 504 as shown in FIGS. 5B and 5D. Previous inserts, for example the insert 100 shown in FIG. 1, include a lip 118 that prevents disposing the insert 100 completely with the shaft 104. The insert 500 of the embodiment shown in FIGS. 5A–E, however, may be fully embedded within the shaft 504. Accordingly, the insert 500 may have a substantially constant outside diameter (without regard to conventional glue grooves) sized to fit within an inside diameter of the shaft 504.

The insert 500 may include one or more ridges 526 about its outer diameter, as shown in FIGS. 5A and 5B. The ridges 526 do not, however, extend beyond the substantially constant outside diameter of the insert 500 and thus do not prevent full insertion of the insert 500 into the shaft 504. The insert may include a through hole, as shown in FIGS. 5C and 5D, or may have a so-called blind hole in the back wall of the insert (not shown).

Figure 4A:
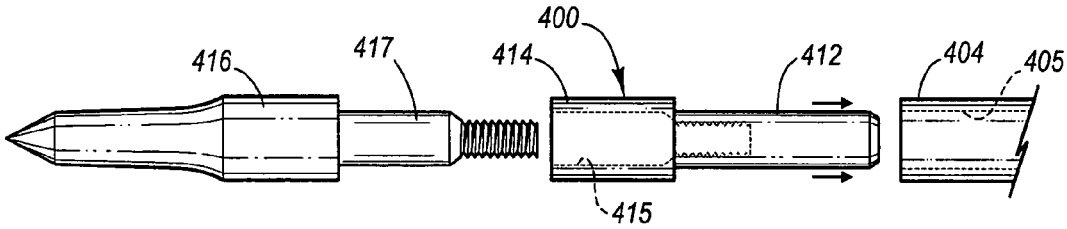
Fig. 4A (Prior Art)
FIG. 4A is a side view of an FRP arrow utilizing half-out inserts according to the prior art.
Figure 4B:
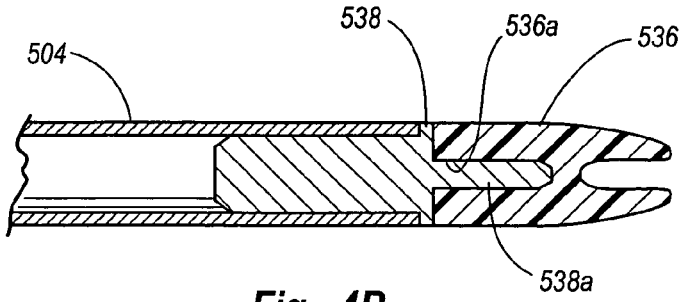
Fig. 4B (Prior Art)
FIG. 4B is a partial sectional side elevation view of a PIN nock system according to the prior art.

The shaft 504 is preferably constructed of a carbon-composite material and includes a first end 522 and a first end wall 524. The first end wall 524 corresponds to the terminating end of shaft 504. The shaft 504 also includes a second end 534 that is receptive of a nock 536. A nock adapting insert 538 may be included between the shaft 504 and the nock 536. Although FIGS. 5A and 5B show such an insert, it is to be understood that any nock system, such as without limitation, direct fit nock systems (e.g., as shown in FIG. 1), UNI™ bushings with g-nock systems (e.g., as shown in FIG. 5B), and PIN nock systems with PIN nocks (e.g., as shown in FIG. 4B), may be used without departing from the scope of the present invention. In addition, a plurality of vanes or other fletching (not shown in the drawings) may be secured to the second end 534 of the shaft.

Figure 5E:
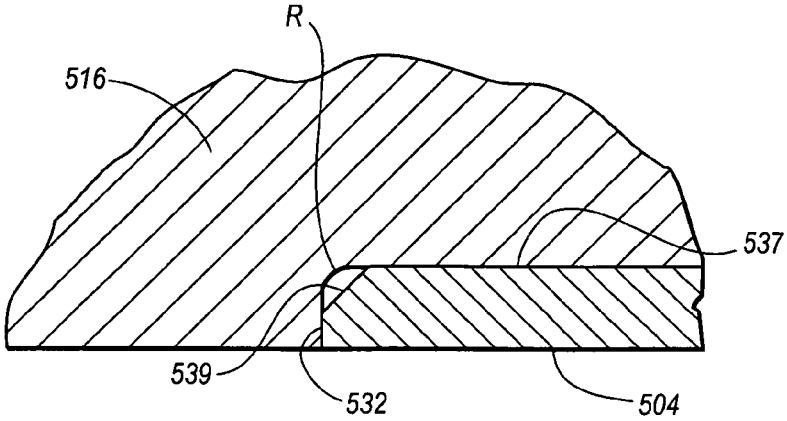
FIG. 5E is an enlarged view of the area 5E—5E of FIG. 5D, according to one embodiment of the present invention.

As mentioned above, the insert 500 is receptive of the point 516. The point 516 is preferably a standard size, commercially available point. The point 516 includes ahead 529 and a shoulder 530 where a relatively greater outside diameter of the point 516 transitions to a shank 531. According to principles described herein, the insert 500 has no lip (e.g., element 118 in FIG. 1) and is inserted to be at least flush with or below the end wall 524 of shaft 504. Therefore, the shoulder 530 of the point 516 advantageously bears directly against the end surface 524 of the shaft 504 as shown in FIGS. 5B, 5D, and 5E. The direct engagement between the shoulder 530 and the end surface 524 according to FIGS. 5A–D provides a first direct interface location 532 (FIGS. 5D and 5E) between the end wall 524 of the shaft 504 and the shoulder 530 of point 516 which facilitates a simpler, more precise alignment between the point and the arrow shaft.

The novel arrow system also provides a second interface location 537 (FIGS. 5D and 5E) between the arrow 504 and the point 516. Specifically, the outside surface of the shank 531 of point 516 bears directly against the inside surface 533 of the arrow shaft 504.

In contrast, prior art arrow systems, as shown in FIG. 1, provided an extra structural element (i.e., the insert) between the arrow shaft and the point at all locations. Thus, prior art arrow systems provided at least four (4) different sets of interfacing surfaces, all of which have the potential to affect alignment of the respective parts. One set is located between the shoulder 117 of the point 116 and the outer, flat surface of lip 118 extending from insert 100. Another is located between the bottom surface 119 of lip 118 and the end surface 124 of the arrow shaft 104. Still another set of interfacing surfaces is between the cylindrical outer surface of the insert 100 and the inside surface 111 of the arrow shaft 104. A final set of interfacing surfaces is between the shank 115 on the point 116 and the corresponding inside cylindrical surface 113 of the insert 100.

Thus, arrow system of the present invention eliminates two of these sets of interfacing surfaces to improve greatly the alignment between the point and the arrow shaft. Specifically, as shown in FIGS. 5C, 5D, and 5E, the present invention provides two sets of direct interfacing surfaces (interfaces 532 and 537 as shown in detail in FIG. 5E) between the arrow shaft 504 and the point 516 to greatly improve alignment. It is to be understood that while some aspects of the present invention are directed to hunting arrows only, this particular aspect of the present invention applies to all types of arrows, both hunting arrows and target arrows.

Figure 5F:
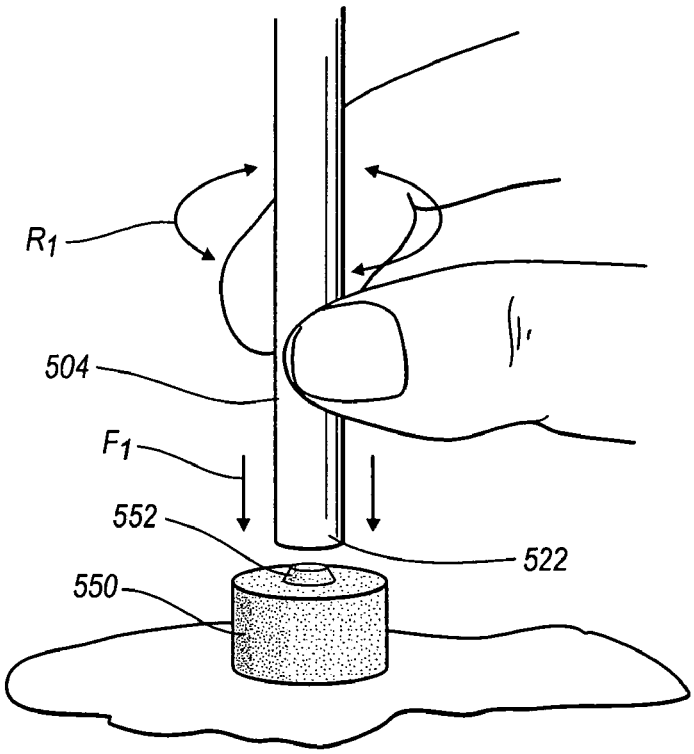
FIG. 5F is a perspective view of an arrow being prepared for receipt of an arrow insert system according to the present invention.
Figure 5G:
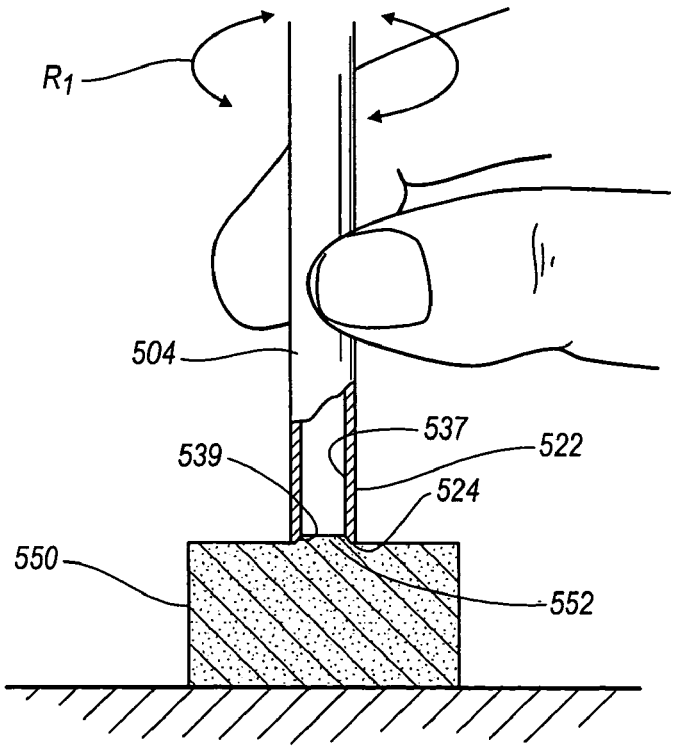
FIG. 5G is a side elevation view, partly in section, of the arrow preparation process shown in Fig. G.

As shown in FIGS. 5F and 5G, an arrow preparation tool 550 is provided to appropriately place a chamfer on the distal end 522 of shaft 504. The arrow preparation tool 550 comprises a frusto-conically shaped protuberance 552 over which an end of arrow shaft 504 is inserted. After the arrow shaft is inserted over protuberance 552, a downward force $F_1$ is applied to the arrow shaft as the shaft is rotated $R_1$ (FIG. 5G) back and forth until the end wall 524 abuts the top surface of preparation tool 550. At that point, a proper chamfer 539 has been created on the distal end 522 of shaft 504 between the end wall 524 and the inside surface 537 of shaft 504. In addition, a portion of end wall 524 will also remain. As shown in FIG. 5E, the purpose for preparing the arrow shaft with a chamfered surface 539 is to accommodate points that may have a radius R (FIG. 5E) between the shoulder 530 and the shank 531. It is to be understood that the arrow preparation tool 550 may be made of any appropriately abrasive material, such as bonded aluminum oxide. As shown in FIGS. 5F and 5G, the arrow preparation tool 550 may be placed on top of a flat surface so that as the arrow is rotated back and forth $R_1$ as shown in FIG. 5G, there is no need to hold the porous, abrasive arrow preparation tool 550. Alternatively, the arrow preparation tool 550 may be held by the person performing the chamfering process. Those skilled in the art will understand that other arrow preparation tools may be utilized without departing from the scope of the present invention. Still further, pre-prepared arrow shafts with appropriate chamfers may be provided to accommodate points with radii, without departing from the scope of the present invention.

Figure 6A:
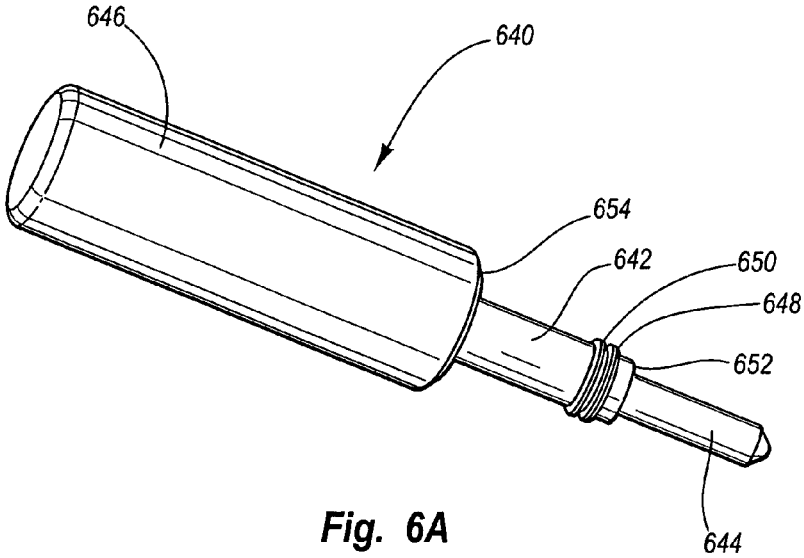
FIG. 6A is a perspective view of an arrow insert installation tool according to one embodiment of the present invention.
Figure 6B:
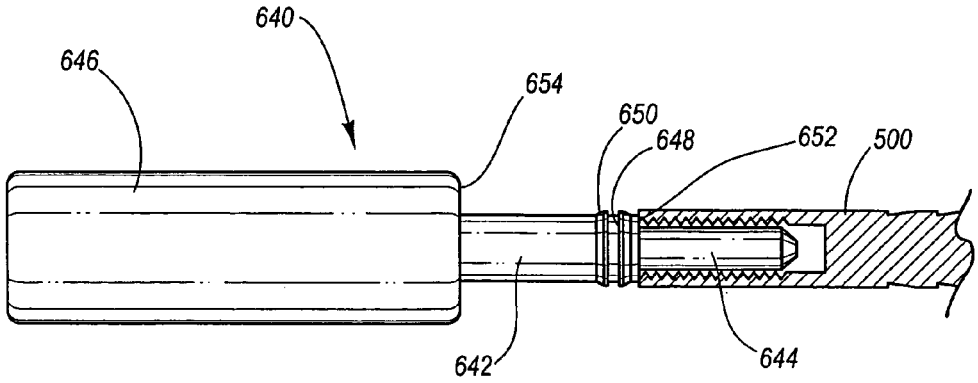
FIG. 6B is a side elevation view of the arrow insert installation tool of FIG. 6A with an insert secured thereto.
Figure 6C:
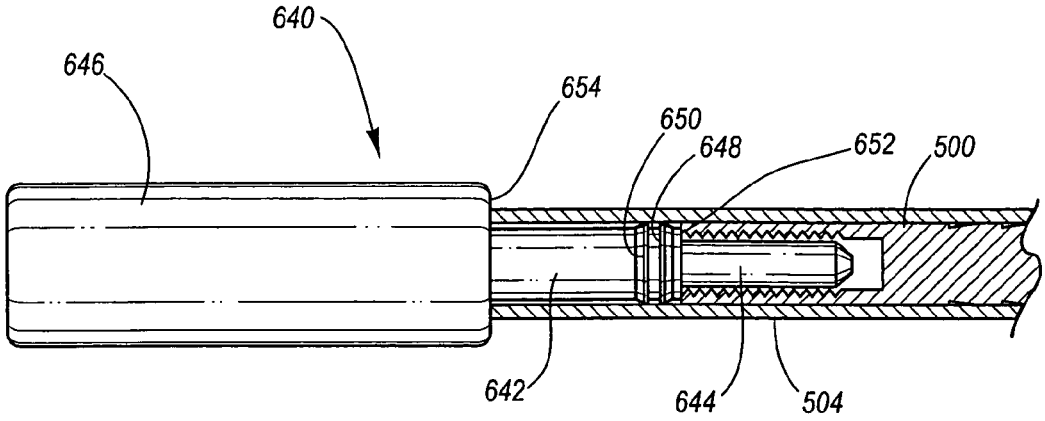
FIG. 6C is a side elevation view, partly in section, of the arrow insert installation tool of FIG. 6A showing the insert being installed inside an arrow shaft.

After the shaft 504 has been properly conditioned, perhaps by arrow preparation tool 550, the insert 500 of FIGS. 5A–E may be installed completely within the shaft 504 in a number of ways. One way might be for a user to couple the insert 500 to the point 516 and install both together as a unit. Another way, however, may be to use an insert installation tool 640, as shown in FIGS. 6A–C. The tool 640 allows the interface 532 between point 516 and shaft 504 to be more precisely controlled. The tool, as discussed below, provides the advantage of precise depth control of the insert 500 and prevents adhesive contamination on the portion of the inside of the shaft corresponding to the area of interface 537 (FIGS. 5D and 5E) between shank 531 of point 516 and the inside surface 533 of shaft 504.

According to the embodiment of FIGS. 6A–C, the insert installation tool 640 includes a rod 642 which extends toward and terminates at a tip or first end 644. The rod 642 attaches to a handle or second end 646, which may be made of any suitable size or shape. The outside diameter of the first end 644 is sized to fit within the threaded section of insert 500. FIG. 6B shows an insert positioned on the first end 644 of the installation tool 640. FIG. 6C shows the insert 500 being positioned inside the arrow shaft 504 using the installation tool 640. The outside diameter of the rod 642 is different than the outside diameter of the tip 644 such that a first shoulder 652 is formed. Therefore, the first shoulder 652 is sized to abut the insert 500, as shown in FIG. 6B, which will allow an operator to push the insert 500 into the arrow shaft 504 to a predetermined, precise depth.

The rod 642 may also include one or more wipers. The embodiment of FIG. 6A–6C comprises a first peripheral ring or lip 648 and a second peripheral ring or lip 650 disposed between the first shoulder 652 and second shoulder 654 of the insert installation tool 640. The first and second wipers 648 and 650 may have equal diameters and may be sized to provide an interference fit with an inside diameter of the arrow shaft 504. The first and second wipers 648 and 650 are intended to remove any excess adhesive from the inside surface of the shaft. According to one embodiment, the diameter of the first and second wipers 648 and 650 is approximately 0.206 inches. Such diameters are not, however, limited to any particular measurement, nor are the first and second wipers 648 and 650 necessarily of equal diameter.

Figure 6D:
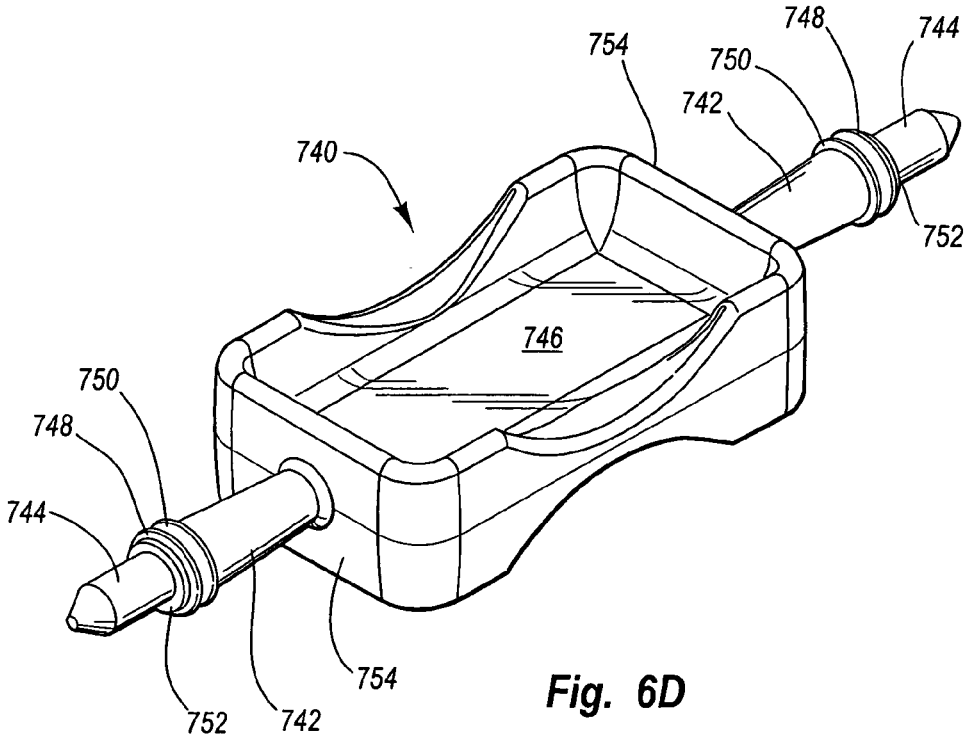
FIG. 6D is a perspective view of an alternative embodiment of an arrow insert installation tool according to the present invention.

Another embodiment of an insert installation tool 740 is shown in FIG. 6D. Each end of the insert installation tool 740 includes a rod 742 which extends toward and terminates at a tip or first end 744. Each rod 742 attaches to a handle or second end 746, which may be made of any suitable size or shape. The handle 746 incorporates an ergonomic design to facilitate grasping by a person doing the insert installation. Any suitable design may be incorporated into the handle 746. The outside diameter of each tip or first end 744 is sized to fit within the threaded section of the inside diameter of the insert 500 (FIG. 6C). Each rod end 744 terminates at a first shoulder 752 and transitions to a second section 742, which terminates, in turn, at the handle portion 746. Each first shoulder 752 is designed to abut an insert 500, in a manner similar to what is shown in FIG. 6B, to allow an operator to push the insert 500 into the arrow shaft 504 to a predetermined, precise depth.

Each rod 742 also includes one or more wipers in the form of a first peripheral ring or lip 748 and an optional second peripheral ring or lip 750 disposed between the first shoulder 752 and wall 754 of handle portion 746. The first and second wipers 748 and 750 may be of equal diameters and may be sized to provide an interference fit with an inside diameter of the arrow shaft 504. The first and second wipers 748 and 750 are intended to remove excess adhesive from the inside surface of the shaft. According to one embodiment, the diameter of the first and second wipers 748 and 750 is approximately 0.206 inches. Such diameters are not, however, limited to any particular measurement, nor are the first and second wipers 748 and 750 necessarily of equal diameter. When tool 740 is used to install insert 500 into shaft 504, the wall 754 of handle 746 abuts the end 524 of the shaft.

In order to facilitate the interference fit between the wipers and the inside diameter of the arrow shaft 504, the insert installation tools 640, 740 may be made of multiple grades and "pliabilities" of plastic or another suitable material that can flex and provide an appropriate interference fit. Still further, the tool 640, 740 could be made of any other material, such as metal, where, for example and without limitation, rubber O-rings are used for the wipers.

Figure 6E:
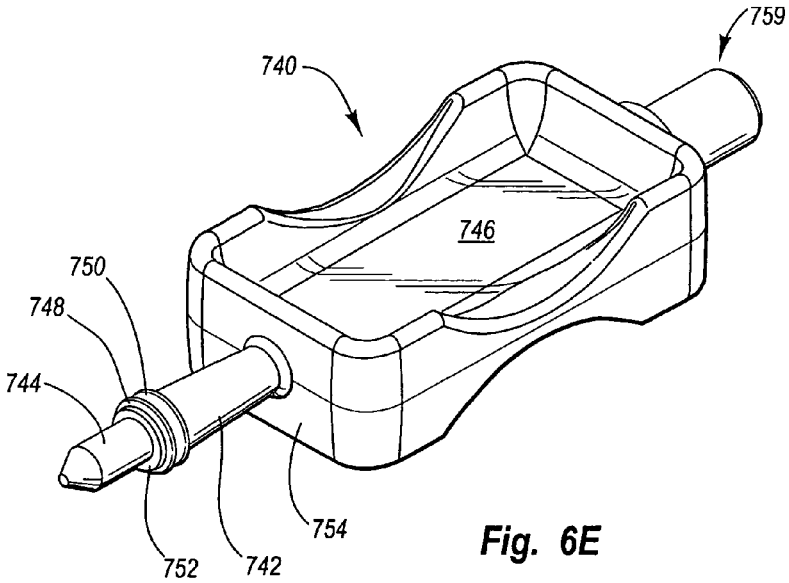
FIG. 6E is a perspective view of another alternative embodiment of an arrow insert installation tool according to the present invention.

Alternatively, as shown in FIG. 6E, tool 740 may include a specialized depth gauge 759 (FIG. 6D) on one end of tool 740 to ensure that chamfer 539 has been properly instilled into shaft 504.

As described in the background, the phenomenon of increased penetration for reduced shaft diameter was generally felt by archers and bowhunters to be true, but was not well addressed in a scientific manner in the past.

Therefore, a number of experiments were performed according the present invention to better understand and evaluate arrow penetration. The tests were performed shooting arrows into industry-standard ballistic gelatin that has heretofore been used for analysis of firearms and ammunition.

Figure 7:
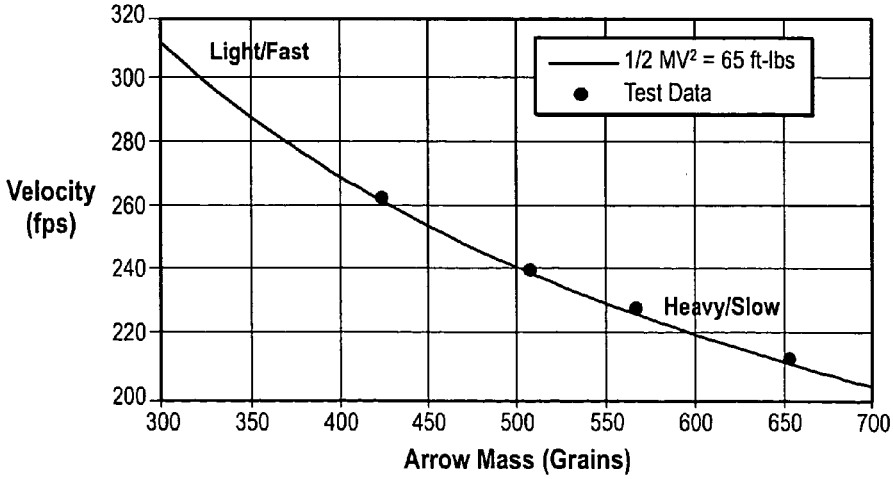
FIG. 7 is a graph illustrating a constant kinetic energy curve plotted on a mass versus velocity chart.

According to one test measuring arrow penetration (Test 1), arrow mass and impact velocity were varied according to the graph shown in FIG. 7 to provide a constant kinetic energy $$\left(\text{kinetic energy} = \frac{1}{2} m \cdot v^2, \quad \text{where } m = \text{total arrow mass and } v = \text{impact velocity}\right)$$

of 65 foot-pounds. The arrows tested were aluminum shafts with a nominal outside diameter of 0.344 inches. Table 1 (below) lists the four specific shafts tested.

TABLE 1

Penetration Test Shaft Description

| Arrow Size Designation (Aluminum Shafts) | Shaft Outside Diameter (in.) | Arrow Mass (grain) (total flight weight of shaft, point, nock, vanes, bushing and adhesives) |
|---|---|---|
| 2212 | 0.3452 | 424.9 |
| 2216 | 0.3460 | 508.3 |
| 2219 Standard | 0.3440 | 567.8 |
| 2219 Heavy (plastic weight tube added to shaft ID) | 0.3440 | 653.8 |

Each arrow included an identical arrow point, which was a fixed-blade broadhead known as a New Archery Products Thunderhead®. Each arrow point had a mass of 85 grains. As shown in Table 1, the variation in shaft outside diameter for each arrow was relatively small such that the interface between arrow and target was substantially the same. However, the difference in mass between the arrows was substantial. Therefore, the bow draw weight was adjusted for each arrow to provide an impact velocity yielding an approximately constant level of kinetic energy at impact. The bow draw weights used for each arrow are shown in Table 2 below.

TABLE 2

Bow Draw Weights and Kinetic Energy at Impact in Test 1

| Arrow Size Designation (Aluminum Shafts) | Bow Peak Draw Weight (lb) | Impact Velocity (fps) | Kinetic Energy at Impact (ft-lb) |
|---|---|---|---|
| 2212 | 64.0 | 263.6 | 65.5 |
| 2216 | 60.0 | 241.0 | 65.5 |
| 2219 Standard | 59.5 | 228.9 | 66.0 |
| 2219 Heavy (plastic weight tube added to shaft ID) | 59.0 | 213.3 | 66.0 |

Figure 8:
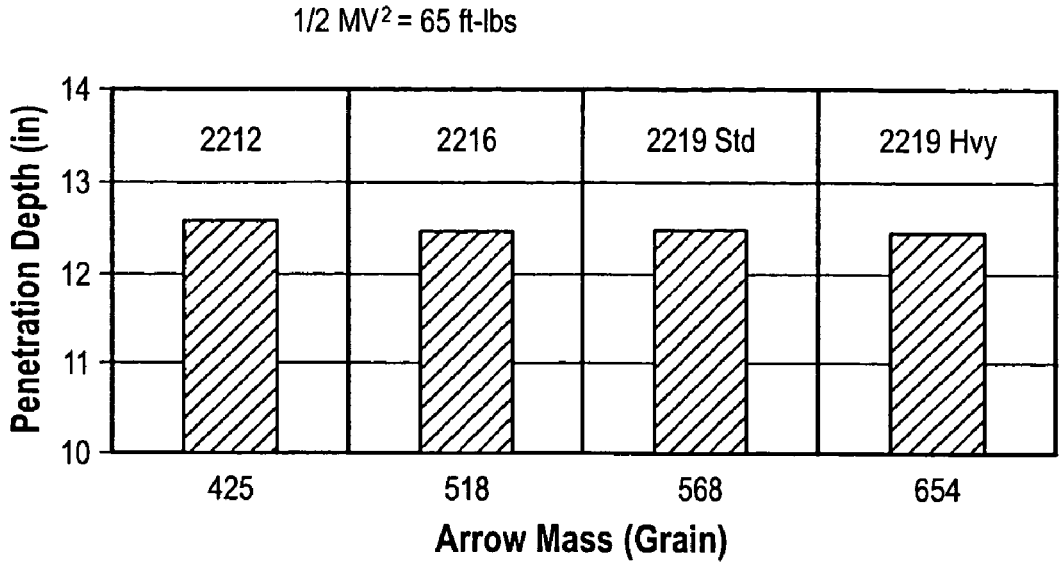
FIG. 8 is a graph illustrating penetration depth of various arrows into a gelatin material, each arrow having substantially the same kinetic energy.

The penetration results from shooting the four arrows according to the test parameters are shown in FIG. 8. The results show that the penetration for all four arrow shafts was the same, approximately 12.5 inches. Such results indicate that for a constant arrow shaft OD, penetration performance is a strong function of kinetic energy, and separate from the independent parameters of mass and velocity. That is, within the range of arrow masses and impact velocities tested, penetration depth was constant if impact kinetic energy was constant, regardless of whether the kinetic energy was achieved by a low mass arrow traveling at high velocity, or a high mass arrow traveling at a low velocity.

To confirm the hypothesis that penetration is only a strong function of kinetic energy, Test 2 was conducted whereby the bow draw weight and resultant impact velocity were varied. The specific test parameters are shown in Table 3 below.

TABLE 3

Bow Draw Weights and Kinetic Energy at Impact in Test 2.

| Arrow Size Designation (Aluminum Shafts) | Bow Peak Draw Weight (lb) | Kinetic Energy at Impact (ft-lb) |
|---|---|---|
| 2212 | 50 | 47 |
| 2216 | 60 | 69 |
| 2219 Standard | 70 | 77 |
| 2219 Heavy (plastic weight tube added to shaft ID) | 70 | 80 |

Figure 9:
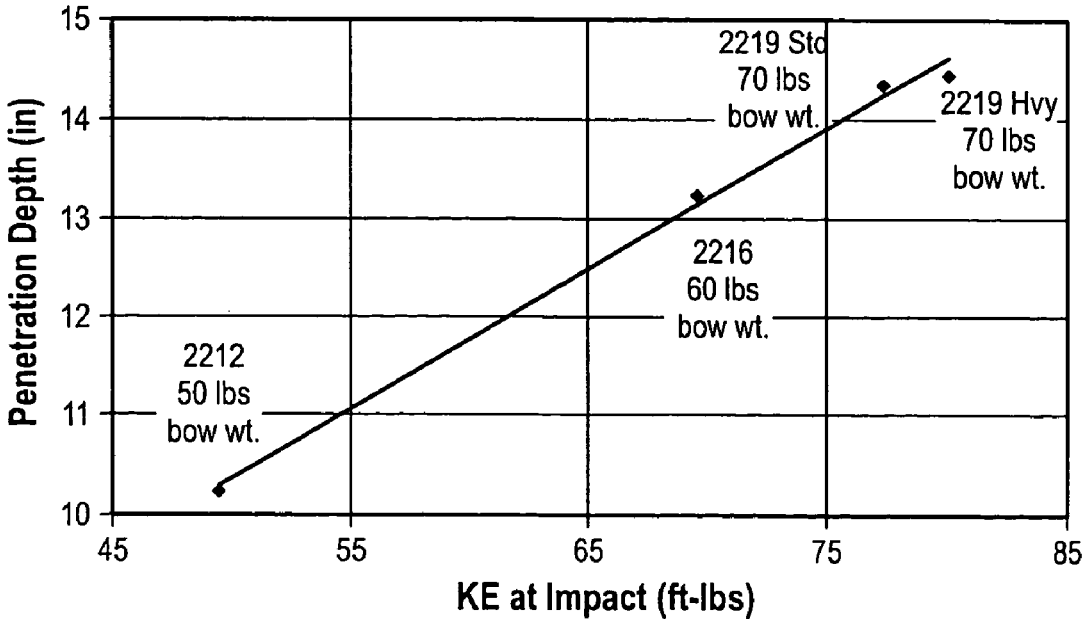
FIG. 9 is a graph illustrating penetration depth of various arrows into a gelatin material as a function of kinetic energy for various arrows.

The results of Test 2 are shown in FIG. 9. Again, penetration is shown to be a strong linear function of impact kinetic energy.

Another test, designated as Test 3, then investigated the effect of shaft outside diameter on penetration performance. For Test 3, two arrows with different outside diameters were used. The first arrow was an ICSHunter® 400 Heavy, and is an internal component carbon-composite shaft. The second was a 2413 aluminum alloy arrow. Again, both were tested with New Archery Products 85 grain Thunderhead® fixed broadheads. Table 4 (below) lists the parameters and results of Test 3.

TABLE 4

Shaft Diameter and Kinetic Energy at Impact in Test 3

| Arrow Size Designation | Shaft Outside Diameter (in.) | Arrow Mass (grain) (total flight weight of shaft, point, nock, vanes, bushing and adhesives) | Impact Kinetic Energy (ft-lb) | Penetration Depth(in.) |
|---|---|---|---|---|
| ICSHunter ® 400 Heavy (FRP) (plastic weight tube added to shaft ID) | 0.2935 | 464.4 | 50.8 | 12.2 |
| 2413 (aluminum) | 0.3719 | 464.1 | 50.6 | 10.0 |

Based on the results of Tests 1 and 2, it was anticipated that the two arrows shot according to the parameters of Test 3 would have nearly identical penetration depths, given the approximately identical impact kinetic energy. Instead, the unexpected result was 22% greater penetration for the smaller diameter ICSHunter® 400 Heavy than for the larger diameter 2413. Test 3 shows that the effective outer dimensions is another key factor in improving penetration performance, and that as the outside diameter of the shaft is reduced, the penetration increases.

Another test (Test 4) was conducted to isolate one other variable and confirm the unexpected results of Test 3. According to the parameters of Test 3, there was room for speculation as to whether the improved penetration depth of the ICSHunter® 400 Heavy was due to its smaller diameter, or to some other factor given FRP construction (as opposed to the aluminum construction of the 2413) of the shaft. Therefore, in Test 4 an aluminum shaft and FRP shaft having substantially the same outside diameters were tested for penetration performance. Table 5 (below) shows the parameters and results of Test 4.

TABLE 5

Shaft Material and Kinetic Energy at Impact in Test 4

| Arrow Size Designation | Shaft Outside Diameter (in.) | Arrow Mass (grain) (total flight weight of shaft, point, nock, vanes, bushing and adhesives) | Impact Kinetic Energy (ft-lb) | Penetration Depth (in.) |
|---|---|---|---|---|
| 1816 (aluminum) | 0.2840 | 409.7 | 50.0 | 11.4 |
| Evolution ™ 500 (FRP) | 0.3003 | 411.2 | 50.3 | 11.3 |

The results of Test 4 indicate that shaft material had no appreciable affect on penetration depth. Thus, the unexpected results achieved pursuant to the results of Test 3 (shown in Table 4) were not attributable to differences in shaft material.

Another penetration test, Test 5, was performed to assess the effect of shaft diameter on penetration performance. In Test 5, three different arrow shafts were constructed according to the parameters of Table 6, set forth below. All shafts were constructed from FRP material. Additionally, the overall length of each shaft was adjusted such that the total arrow mass would be substantially identical. As in the other penetration tests, NAP Thunderhead™ 85 grain broadheads were used. The only difference among the various shafts was the outside diameters. The ICSHunter® and Fat Boy™ models and other similar large diameter shafts represent shafts available on the market today. The bow parameters utilized in Test 5 were selected and adjusted during the test so that the impact velocities, and thus the kinetic energies at impact, for all arrows into the ballistic gelatin targets were substantially identical. Prior tests, specifically Test 1, established that penetration depth into the gelatin target was identical if the kinetic energy at impact was held constant and the outside "envelope" (i.e., the shaft diameter and point interfacing with the target material) were unchanged. As with the prior test, the kinetic energy for Test 5 was maintained constant.

In Test 5, the kinetic energy at impact was constant because both arrow masses and impact velocities were held constant. Therefore, one might expect that the penetration depth would be the same for all arrows tested, unless another variable had a significant effect on the penetration result. In Test 5, the variable of shaft outside diameter was well isolated, and would be the only factor which could have an effect on depth of penetration. The present invention demonstrates that shaft outside diameter is a variable that directly and linearly affects depth of penetration.

Figure 10:
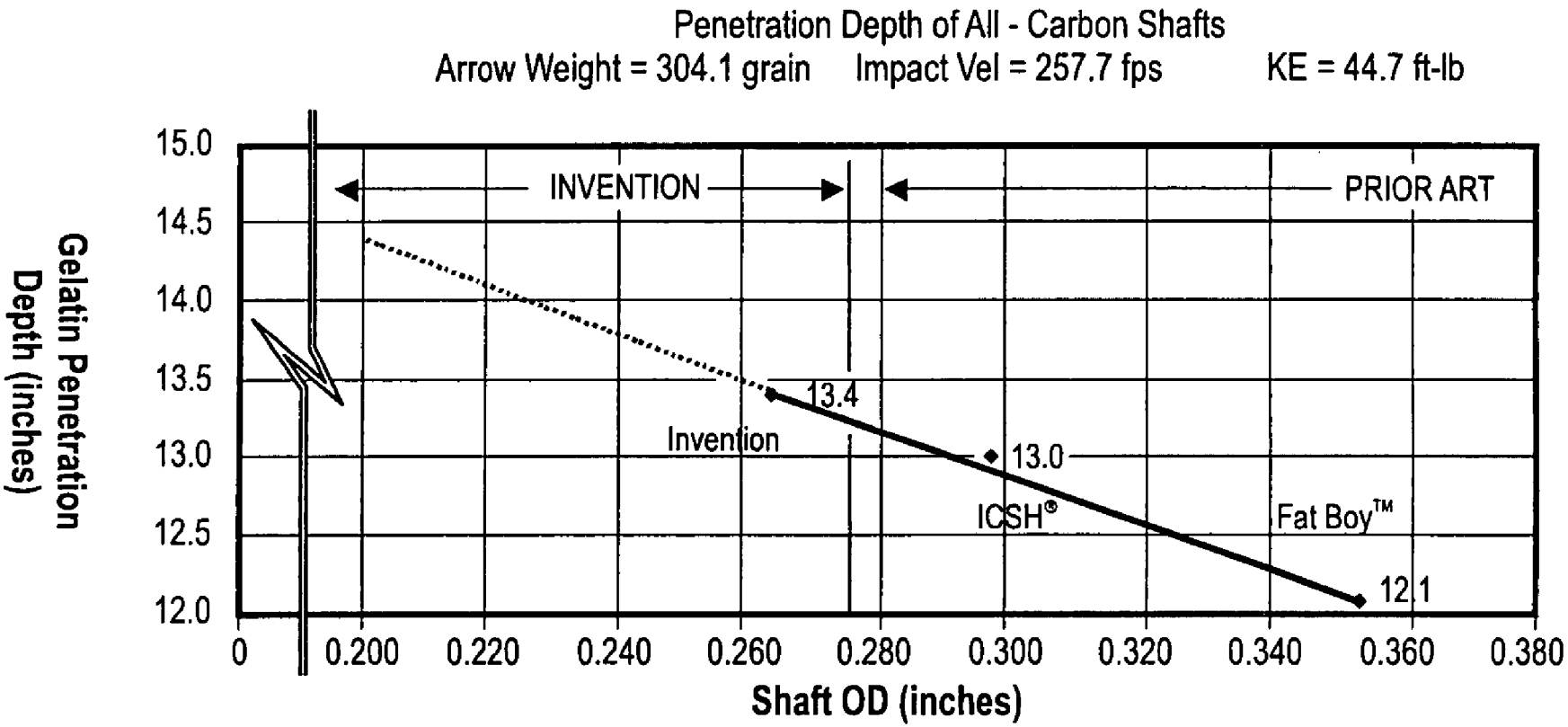
FIG. 10 is a graph illustrating penetration depth of different FRP arrow shafts into a gelatin material where kinetic energy has been maintained constant and the shaft outside diameter has changed.

Table 6 shows the results of Test 5, particularly relative to penetration depth. Unlike the results in Test 1, the penetration depths are not the same. Rather, the smaller outside diameter shaft had improved penetration relative to the larger outside diameter shafts of the prior art. FIG. 10 plots depth of penetration as a function of shaft outside diameter for the arrow shafts evaluated in Test 5. As can be appreciated, penetration depth turns out to be a very strong linear function of shaft outside diameter. In FIG. 10, the solid line connecting the three data points represents the actual physical testing conducted. The dashed line extrapolates this data to even smaller shaft outside diameters that have not been tested, but would reasonably be expected to exhibit the same improved penetration performance. Accordingly, these ranges of outside diameters shall be considered part of the present invention.

TABLE 6

Arrow Parameters and Penetration Parameters of Test 5

| Model | OD (in) | Avg Wt (gr) | Avg Impact Vel (fps) | Avg KE (ft-lb) | Penetration Depth (in) |
|---|---|---|---|---|---|
| Invention | 0.264 | 304.0 | 258.2 | 44.7 | 13.4 |
| ICSHunter ® | 0.296 | 304.2 | 257.1 | 44.6 | 13.0 |
| FatBoy ™ | 0.353 | 304.1 | 257.9 | 44.9 | 12.1 |

Therefore, according to embodiments of the present invention, the arrow shaft outside diameter is reduced relative to standard sizes to increase arrow penetration performance. The embodiments described below include shaft diameters of reduced size relative to conventional hunting arrows to better optimize accuracy, time-of-flight, trajectory, and penetration.

The arrow shaft invention is unique in that it provides a certain combination of spine and weight with a smaller outside diameter (OD) than the prior art hunting arrows on the market today. The present invention pertains to FRP shafts which use internal fit components and have spine/weight relationships useful for hunting, and further pertains to all types of aluminum-carbon arrow shafts. It does not include other external fit (outsert) components, nor does it include the general class of target arrows, which have a spine from 0.450 inches to greater than 1.000 inches.

Figure 11:
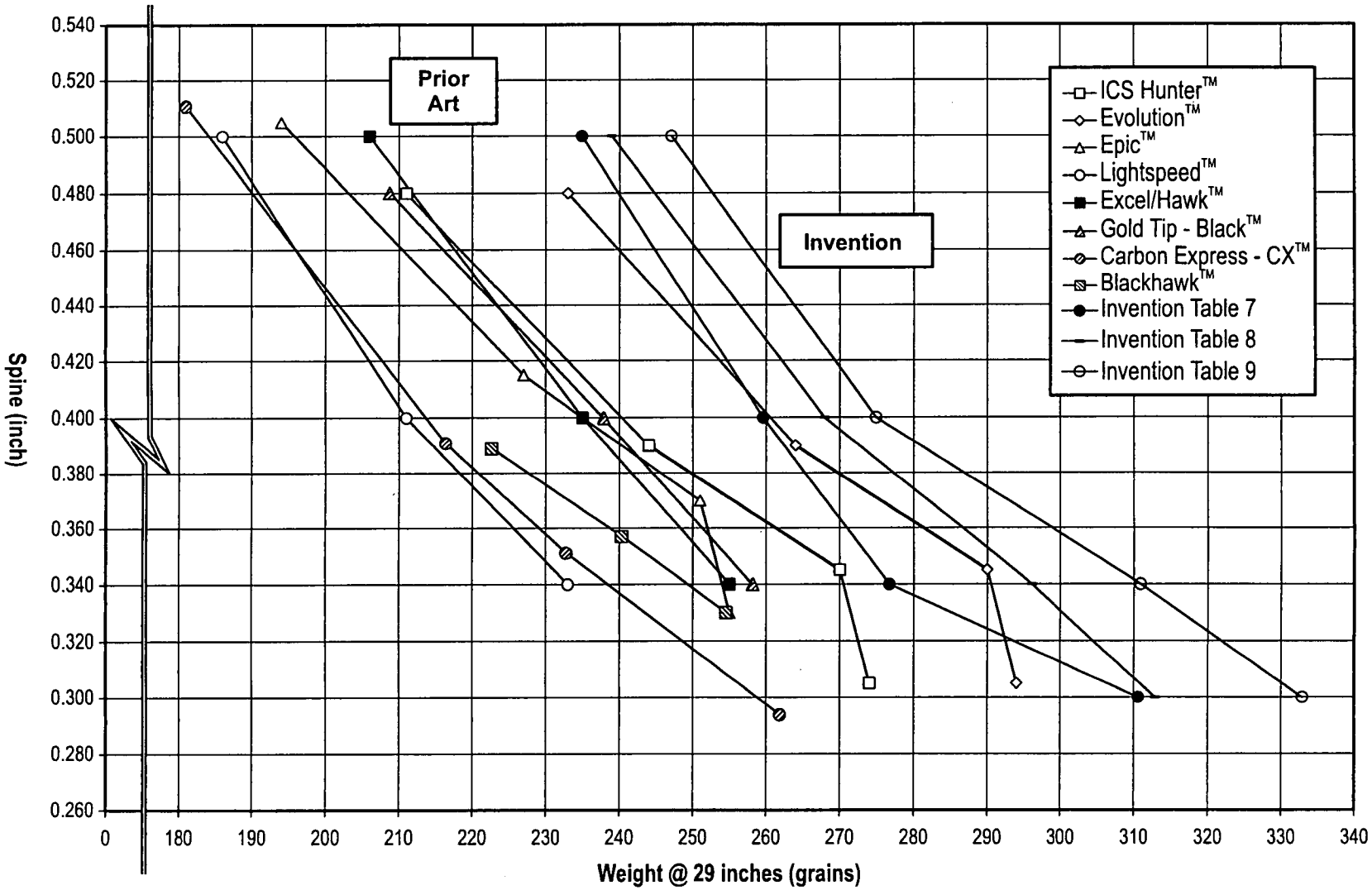
FIG. 11 is a graph illustrating spine vs. weight characteristics of various prior art shafts as well as shafts according to the present invention.

FIG. 11 shows a typical plot of spine vs. weight for various internal fit component, FRP arrow shafts. According to FIG. 11, the spine-weight relationship of the arrow shaft of the present invention is well within the range of other, common spine-weights that have been established for hunting arrows. FIG. 11 does not, however, distinguish among the outside diameters of the shafts.

Figure 12:
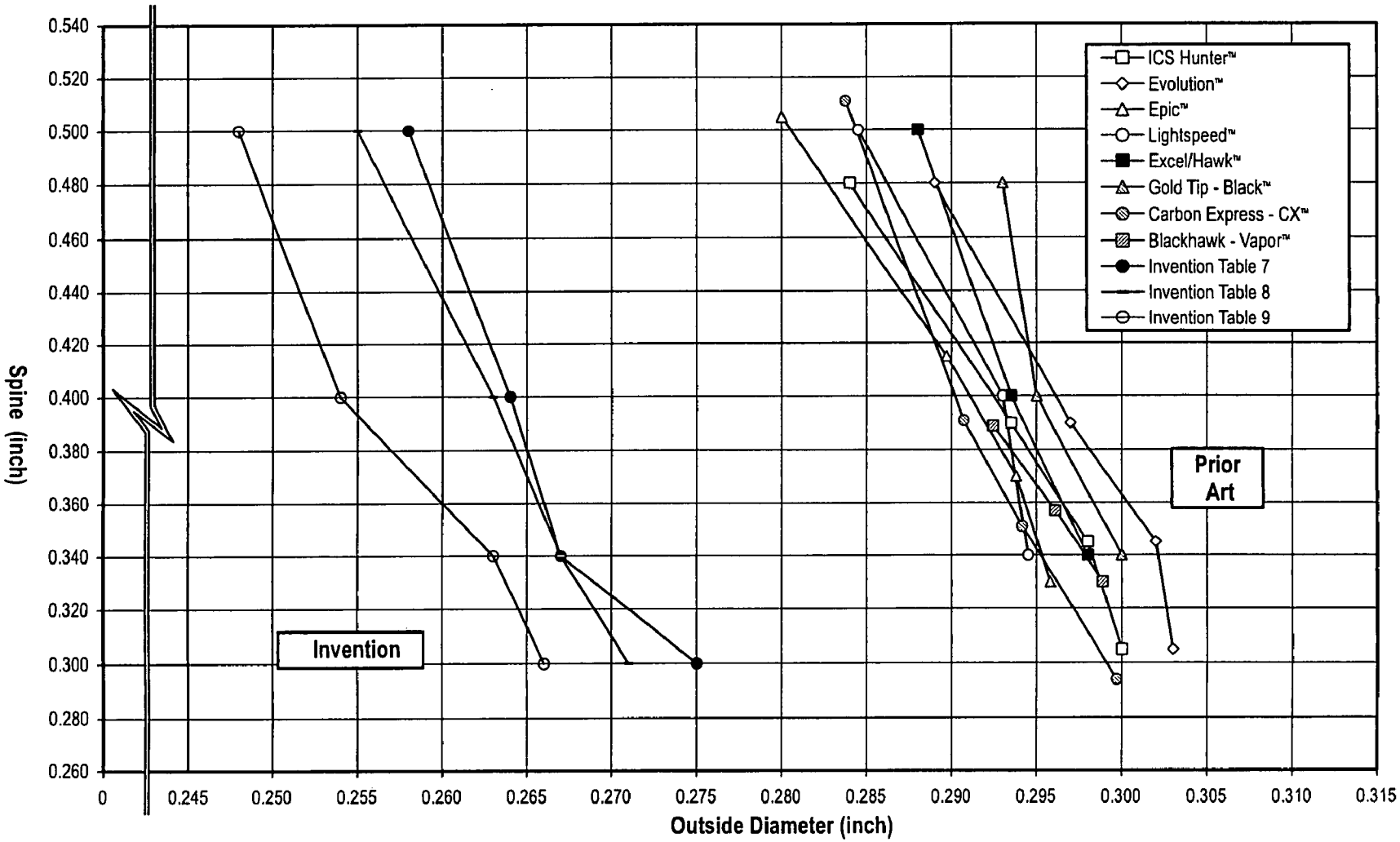
FIG. 12 is a graph illustrating various spine vs. outside diameter characteristics of various prior art arrow shafts as compared to arrow shafts according to the present invention.

FIG. 12 shows a plot of the same arrow shafts in FIG. 11, but FIG. 12 plots the spine vs. outside diameter of the arrows represented. FIG. 12 shows that prior art arrow shaft designs are all tightly grouped together. The stiffest shafts (those with spine values of 0.340 inches or less) fall in an OD range of 0.294 inches to 0.303 inches. The weakest prior art shafts (those with spine values of 0.480 inches or greater) in FIG. 12 fall in an OD range of 0.280 inches to 0.293 inches. In contrast, the arrow shaft of the present invention has, in one embodiment, an OD of 0.275 inches for a spine of 0.300 inches. In another embodiment, the arrow shaft of the present invention has an OD of 0.258 inches for a spine of 0.500 inches.

Figure 13:
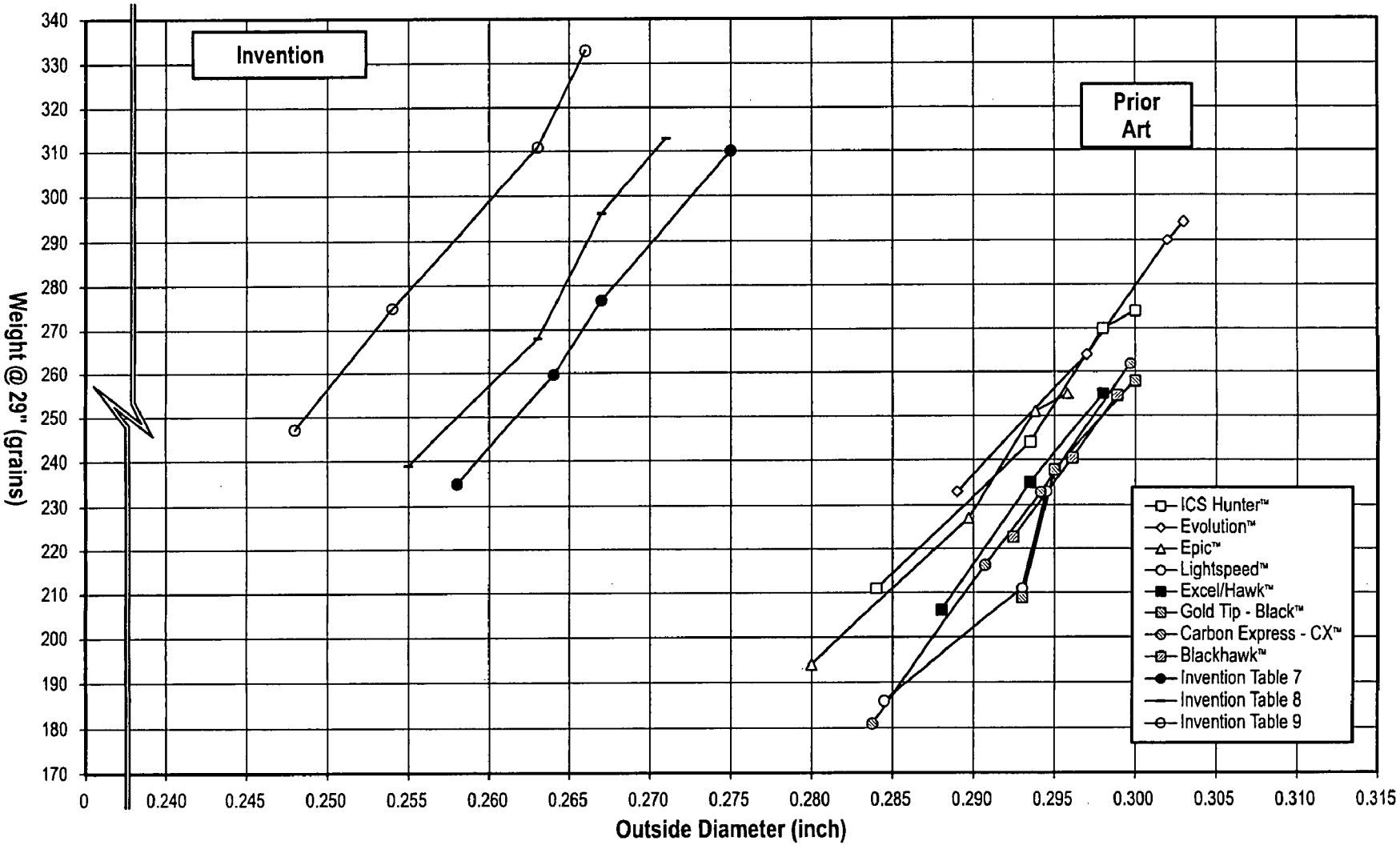
FIG. 13 is a graph illustrating weight vs. outside diameter characteristics of various prior art arrow shafts compared to arrow shafts according to the present invention.

FIG. 13 shows a plot of the weights vs. ODs for the same family of arrow shafts as FIGS. 11 and 12. Again, prior art designs are tightly grouped together. The heaviest shafts (those weighing 255 grains and up) from the prior art group have ODs ranging from 0.296 inches to 0.303 inches. The lightest shafts (those weighing 211 grains or less) from the prior art group have ODs ranging from 0.280 inches to 0.293 inches. This is a significant difference from the arrow shaft of the present invention, which has an OD of 0.275 inches for the heaviest design of one embodiment (310 grains) and an OD of 0.258 inches for its lightest design of 235 grains.

Thus, FIGS. 12 and 13 are clear illustrations that the shaft of this invention is new and unique in its combination of spine/weight/outside diameters. None of the prior art hunting shafts recognize the utility of this combination, and in fact are all grouped together in a significantly larger OD regime.

The accuracy of reduced diameter arrows made according to principles described herein is increased because the propensity of an arrow to be influenced during flight by external factors (e.g., cross winds) is reduced by a smaller diameter shaft. A smaller diameter shaft has a smaller surface area for a cross wind or other external force to act upon. Because of the many point and nock components of standard sizes currently available, however, it may also be desirable to combine reduced outside diameter shafts for the purposes described above, with inside diameters receptive of standard arrow components.

Therefore, hunting arrow shafts may, according to principles described herein, include shafts that have an inside diameter of 0.204 inches to accommodate all standard hunting points currently available. The hunting arrows according to principles described herein may therefore include the advantages of a smaller shaft diameter and the convenience of compatibility with standard hunting points. For example, according to some embodiments of the present invention there may be arrow shafts having an inside diameter of 0.204 inches, a spine of 0.500 inches or less, and an outside diameter of less than 0.275 inches. The outside diameter may range, according to some embodiments, between 0.248 and 0.275 inches, depending upon spine. According to another embodiment the inside diameter is 0.204 inches, the spine is 0.500 inches or less, and the outside diameter is less than approximately 0.275 inches. Other exemplary embodiments may include arrow shafts having the following combinations of parameters (see Table 7 below).

TABLE 7

Reduced diameter arrow parameters according to some embodiments

| Spine (in.) | OD (in.) | Wall Thickness (in.) | ID (in.) | Weight (grains/in., optional parameter) |
|---|---|---|---|---|
| 0.300 | 0.275 | 0.035 | 0.204 | 10.7 |
| 0.340 | 0.267 | 0.031 | 0.204 | 9.5 |
| 0.400 | 0.264 | 0.030 | 0.204 | 9.0 |
| 0.500 | 0.258 | 0.027 | 0.204 | 8.1 |

The reduced diameter arrow shafts may also be used with the insert 500 and the insert installation tool 640 described above.

Arrow shaft diameters may be even further reduced, although they may no longer be compatible with standard points. Instead, the arrow shaft diameters may be sized for half-out inserts. For example, according to embodiments of the present invention there may be arrow shafts having an inside diameter of 0.200 inches, a spine of 0.500 inches or less, and an outside diameter of 0.271 inches or less. Other exemplary embodiments may include arrow shafts having the following combinations of parameters (see Table 8 below).

TABLE 8

Reduced diameter arrow parameters according to some embodiments

| Spine (in.) | OD (in.) | Wall Thickness (in.) | ID (in.) | Weight (grains/in., optional parameter) |
|---|---|---|---|---|
| 0.300 | 0.271 | 0.037 | 0.200 | 10.8 |
| 0.340 | 0.267 | 0.035 | 0.200 | 10.2 |
| 0.400 | 0.263 | 0.033 | 0.200 | 9.2 |
| 0.500 | 0.255 | 0.029 | 0.200 | 8.2 |

In addition to using half-out inserts, the insert 500 of FIGS. 5A–D may be specially sized to fit within the 0.200 inch inside diameter shafts. New, specially sized points of a diameter and thread different than standard points currently in use may be needed to engage such a specially sized insert.

Arrow shaft diameters may be even further reduced, although they may not be compatible with standard points or half-out inserts. Instead, the arrow shaft diameters may necessitate insert components (including inserts shaped according to principles described above) sized to fit the further reduced diameter shafts. For example, according to embodiments of the present invention there may be arrow shafts having an inside diameter of less than 0.200 inches, a spine of 0.500 inches or less, and an outside diameter of less than 0.275 inches. The inside diameter may be, for example, 0.187 inches and the outside diameter may range between 0.230 and 0.270 inches. Other exemplary embodiments may include arrow shafts having the following combinations of parameters (see Table 9 below).

TABLE 9

Reduced diameter arrow parameters according to some embodiments

| Spine (in.) | OD (in.) | Wall Thickness (in.) | ID (in.) | Weight (grains/in., optional parameter) |
|---|---|---|---|---|
| 0.300 | 0.266 | 0.040 | 0.187 | 11.5 |
| 0.340 | 0.263 | 0.038 | 0.187 | 10.7 |
| 0.400 | 0.254 | 0.034 | 0.187 | 9.5 |
| 0.500 | 0.248 | 0.031 | 0.187 | 8.5 |

The outside diameters shown in Table 9 may be even further reduced, if desired.

Figure 14A:
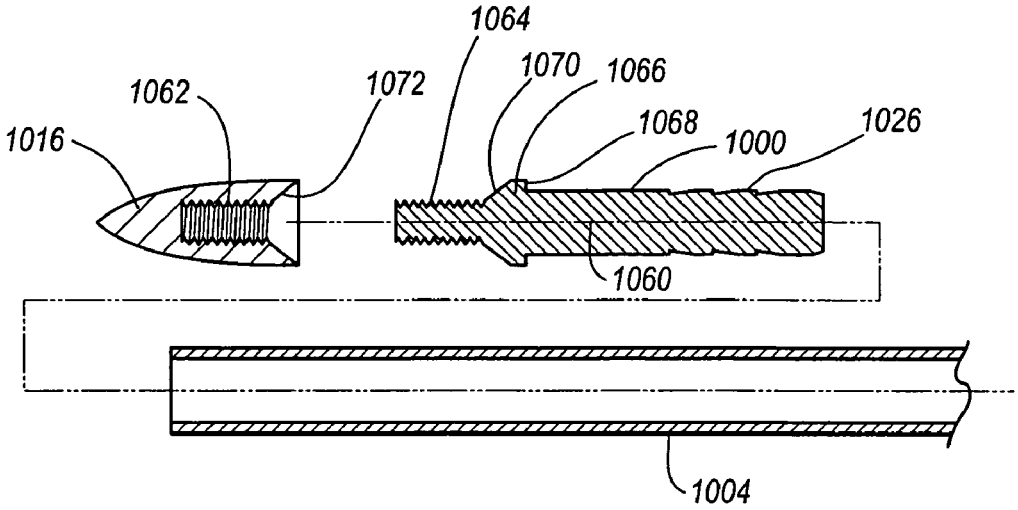
FIG. 14A is an exploded sectional side elevational assembly view of an arrow system according to an alternative embodiment of the present invention.
Figure 14B:
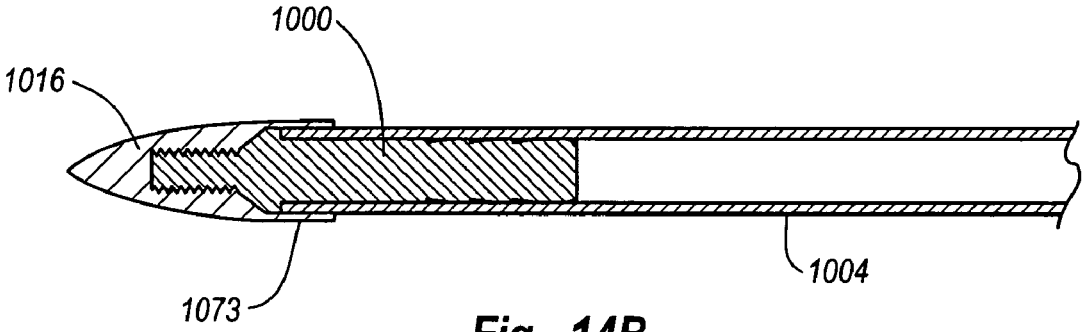
FIG. 14B is a sectional side elevational assembly view of an arrow system according to yet another alternative embodiment of the present invention.
Figure 14C:
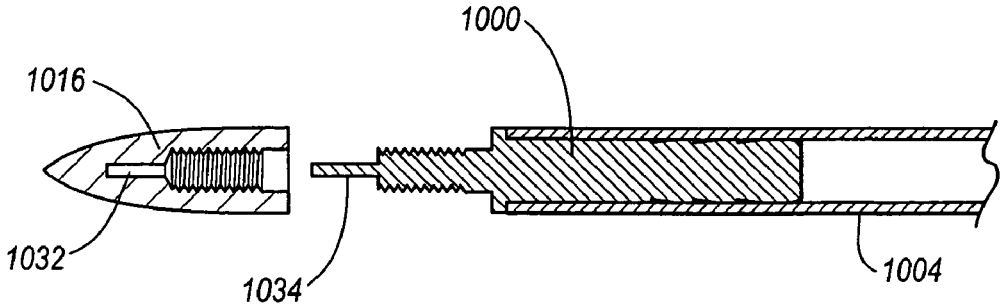
FIG. 14C is an exploded sectional side elevational assembly view of an arrow system according to still another alternative embodiment of the present invention.

Although it may be convenient to use readily available standard points for the shafts and inserts described above, a new arrow point assembly according to various embodiments of the present invention are shown with reference to FIGS. 14A–14C. Typical arrow point assemblies (e.g. FIG. 1) include the female insert 100, FIG. 1 and the male point 116, FIG. 1. However, according to the embodiment of FIGS. 14A–14C, there is a male insert 1000 and a female point 1016. The male insert 1000 includes a first end 1060 sized for insertion into a standard or non-standard arrow shaft 1004. The first end 1060 may include one or more ridges 1026 disposed about its outside diameter. The male insert includes a second end 1064 externally threaded to engage internal threading 1062 of the female field point 1016. Between the first and second ends 1060 and 1064 is a tapered head 1066 that includes a shoulder 1068 sized to approximately the same outside diameter of the shaft 1004. Shoulder 1068 bears against the shaft 1004 when the first end 1060 of the male insert 1000 is inserted into the shaft 1004. The head 1066 also includes a tapered surface 1070 opposite of the shoulder 1068. A mating internal taper 1072 is disposed in the point 1016 and facilitates alignment between the field point 1016 and the insert 1000.

As shown in FIG. 14B, the point 1016 may include an extension or flange in the form of a skirt 1073 that extends over shaft 1004 so that the skirt 1073 in essence envelops the shaft 1004 to aid in alignment.

An alternative embodiment is shown in FIG. 14C. The point 1016 may include a pilot aperture or female pocket 1032 which interfaces with a pilot extension or male end 1034 of the male insert 1000. The pilot aperture 1032 and pilot extension 1034 are circular in cross section, which allows point 1016 to be rotated relative to insert 1000. The pilot members 1032, 1034 further aid in alignment of the point 1016 and shaft 1004.

Although the arrow point assembly of FIGS. 14A–14C may be used with the reduced diameter shafts described above, it should not be so limited. The arrow point assembly of FIGS. 14A–14C may also be used with any other type of suitable arrow shafts.

Figure 15A:
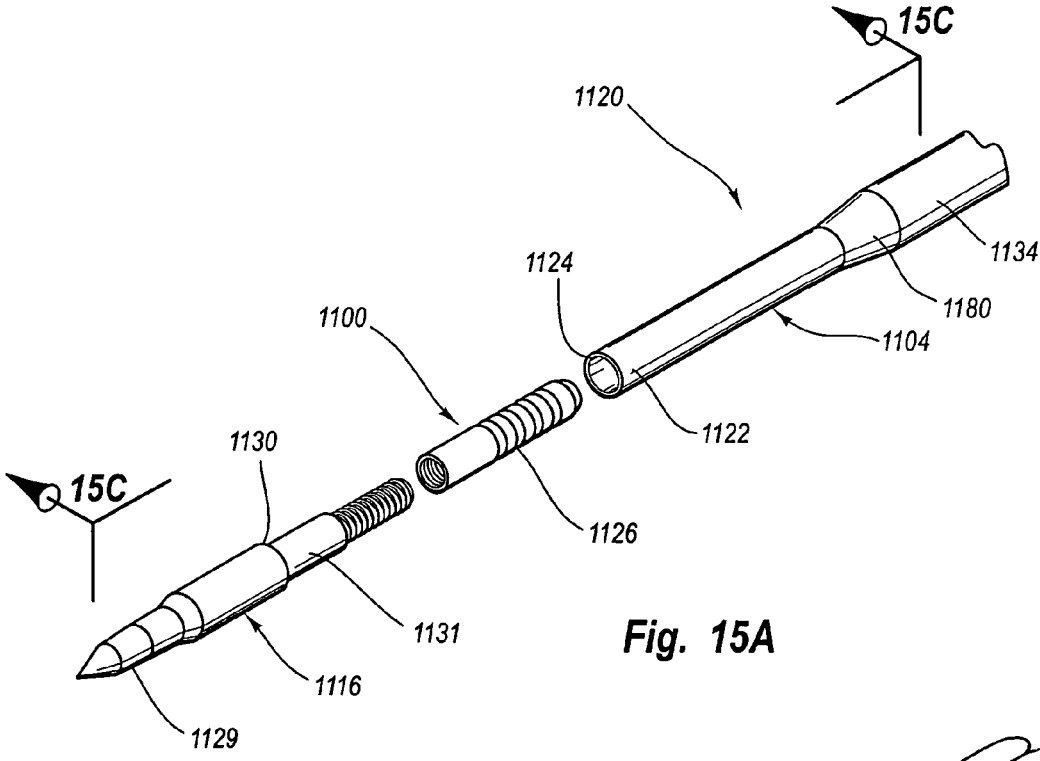
FIG. 15A is an exploded perspective assembly view of an arrow system according to another embodiment of the present invention.
Figure 15B:
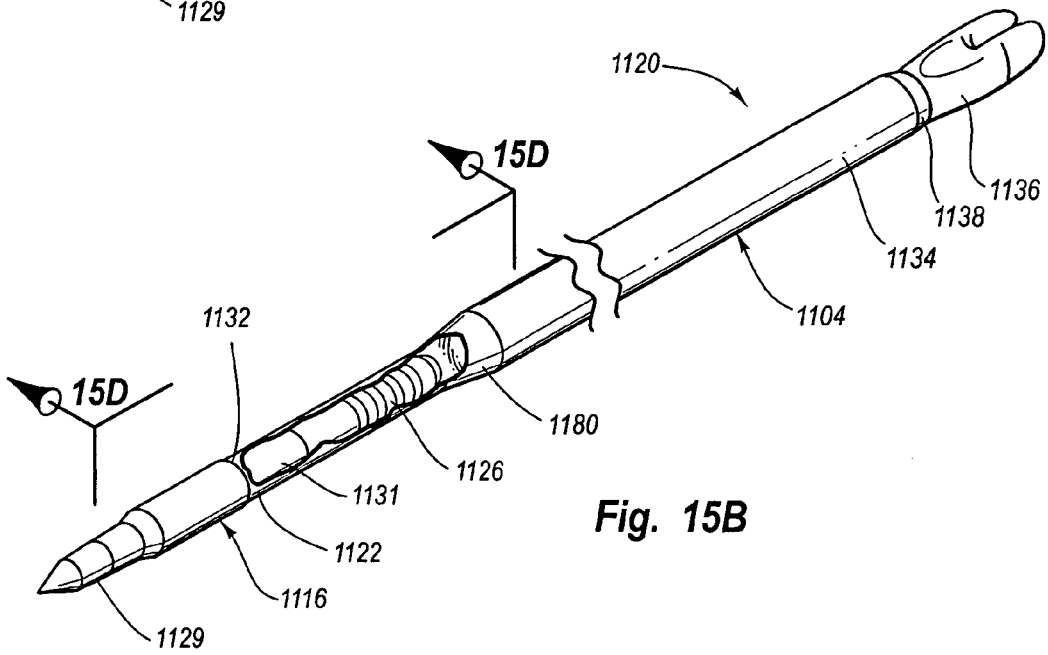
FIG. 15B is an assembled perspective view of the arrow system shown in FIG. 15A.
Figure 15C:
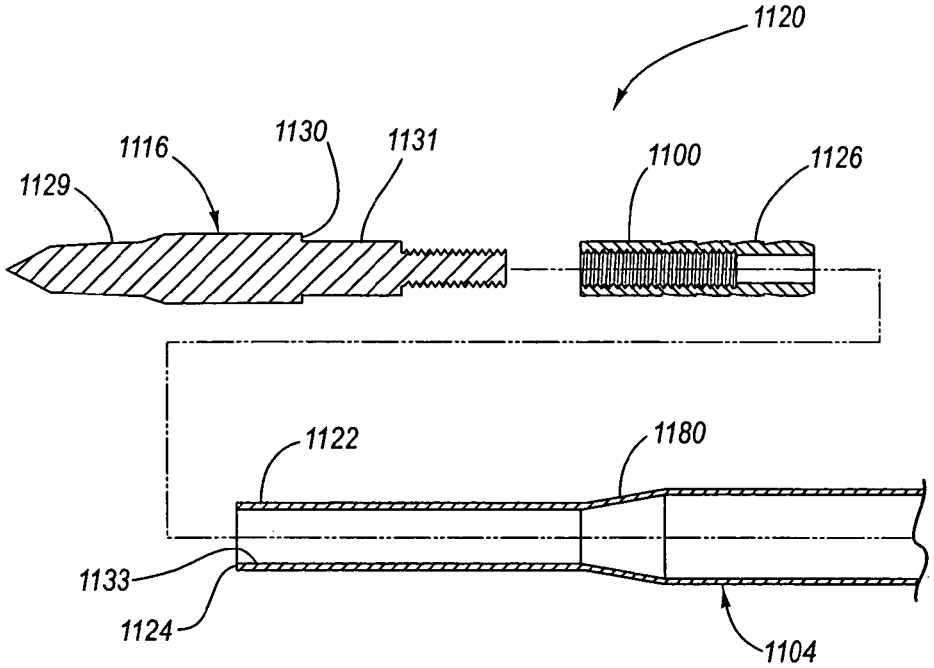
FIG. 15C is an exploded partial sectional side elevation view of an end of the arrow system shown in FIG. 15A.
Figure 15D:
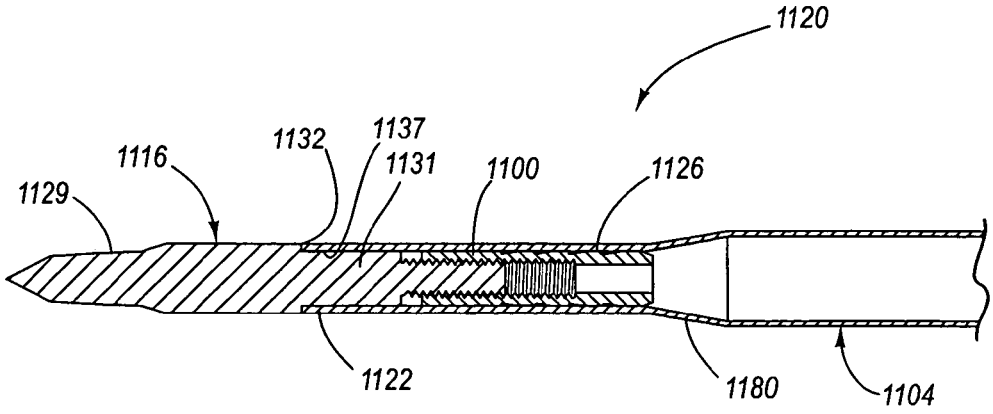
FIG. 15D is an assembled partial sectional side elevation view of the end of the arrow as shown in FIG. 15C.

Another embodiment of the invention is shown in FIGS. 15A–15D. According to FIGS. 15A–15D, an arrow 1120 is shown and includes a shaft 1104 and an insert 1100. The insert 1100 is receptive of a point 1116. The insert 1100 is advantageously sized to fit snugly completely within the shaft 1104 as shown in FIGS. 15B and 15D. Accordingly, the insert 1100 may have a substantially constant outside diameter (without regard to conventional glue grooves) sized to fit fully within an inside diameter of the shaft 1104.

The insert 1100 may include one or more ridges 1126 about its outer diameter, as shown in FIGS. 15A and 15B. The ridges 1126 do not, however, extend beyond the substantially constant outside diameter of the insert 1100 and thus do not prevent full insertion of the insert 1100 into the shaft 1104. The insert may include a through hole, as shown in FIGS. 15A and 15C, or may have a so-called blind hole in the back wall of the insert (not shown).

The shaft 1104 is preferably constructed of a metal such as aluminum and includes a front end portion 1122 and a front end wall 1124. The front end wall 1124 corresponds to the terminating end of shaft 1104. The front end portion 1122 is tapered to a reduced outside diameter at a transition portion 1180. The front end portion 1122 corresponds to point end, as opposed to a rear or nock end. Preferably, the inside diameter of the front end portion 1122 is sized to receive the insert 1100, which is sized substantially the same as the insert 500 of FIG. 5A. According to some embodiments, the front end portion 1122 of reduced diameter comprises a length of approximately 0.5 to 3 inches, preferably about 1.5 inches. According to some embodiments, the front end portion 1122 has an OD of approximately 0.275 inches or less. In another embodiment, front end portion 1122 has an OD of 0.258 inches or less. The ID of the front end portion 1122 is approximately 0.200 inches according to some embodiments. In other embodiments, the ID of the front end portion 1122 is approximately 0.204 inches.

The shaft 1104 also includes a second or rear end portion 1134 comprising a standard outside diameter consistent with conventional aluminum arrow shafts, although non-conventional outside diameters may also be used. A portion of the shaft 1104 extending between the rear end portion 1134 and the transition region 1180 is of substantially constant outside diameter and equal to the outside diameter of the rear end portion 1134.

According to some embodiments, the inside diameter of the front end portion 1122 corresponds to a diameter completely receptive of the insert 1100, and the rear end portion 1134 (and all portions of the shaft 1104 other than the front end portion 1122 and the transition region 1180) comprises a larger, preferably standard-sized inside diameter. The front end portion 1122 preferably has a thicker wall thickness than the remainder of the shaft 1104. Therefore, the shaft 1104 is stronger along the front end portion 1122 than conventional aluminum arrow shafts.

The rear end portion 1134 is receptive of a nock 1136. A nock adapting insert 1138 may be included between the shaft 1104 and the nock 1136. Although FIG. 15B show such an insert, it is to be understood that any nock system, such as without limitation, direct fit nock systems (e.g., as shown in FIG. 1), UNI™ bushings with g-nock systems (e.g., as shown in FIG. 5B), and PIN nock systems with PIN nocks (e.g., as shown in FIG. 4B), may be used without departing from the scope of the present invention. In addition, a plurality of vanes or other fletching (not shown in the drawings) may be secured to the rear end portion 1134 of the shaft 1104.

Similar to embodiments above, the insert 1100 is receptive of the point 1116. The point 1116 is preferably a standard size, commercially available point. The point 1116 includes a head 1129 and a shoulder 1130 where a relatively greater outside diameter of the point 1116 transitions to a shank 1131. According to principles described herein, the insert 1100 has no lip (e.g., element 118 in FIG. 1) and is inserted to be at least flush with or below the end wall 1124 of shaft 1104. Therefore, the shoulder 1130 of the point 1116 advantageously bears directly against the front end surface 1124 of the shaft 1104 as shown in FIGS. 15B and 15D. The direct engagement between the shoulder 1130 and the end surface 1124 according to FIGS. 15A–D provides a first direct interface location 1132 (FIGS. 15B and 15D) between the end wall 1124 of the shaft 1104 and the shoulder 1130 of the point 1116 which facilitates a simpler, more precise alignment between the point and the arrow shaft.

The novel arrow system also provides a second interface location 1137 (FIG. 15D) between the shaft 1104 and the point 1116. Specifically, the outside surface of the shank 1131 of the point 1116 bears directly against and the inside surface 1133 (FIG. 15C) of the arrow shaft 1104. Accordingly, as shown in FIGS. 15B and 15D, the present invention provides two sets of direct interfacing surfaces (interfaces 1132 and 1137) between the arrow shaft 1104 and the point 1116 to greatly improve alignment. It is to be understood that while some aspects of the present invention are directed to hunting arrows only, this particular aspect of the present invention applies to all types of arrows, both hunting arrows and target arrows. As with the carbon arrows described above, the reduced diameter front end portion 1122 results in better penetration than standard aluminum arrows.

Figure 16A:
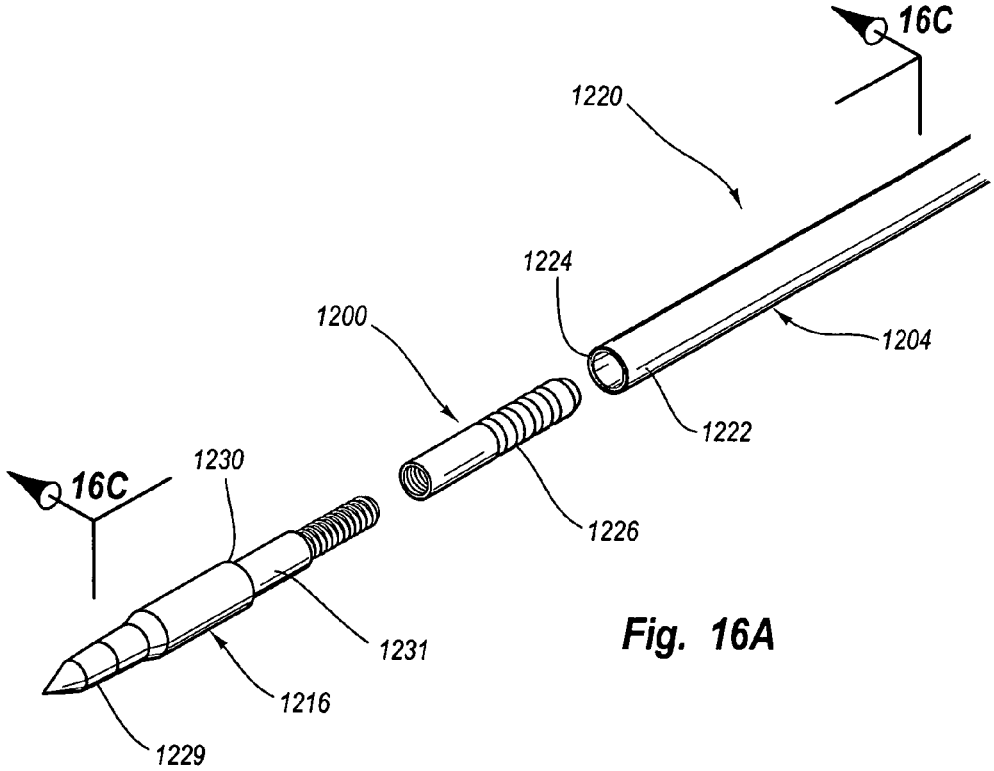
FIG. 16A is an exploded perspective assembly view of an arrow system according to another embodiment of the present invention.
Figure 16B:
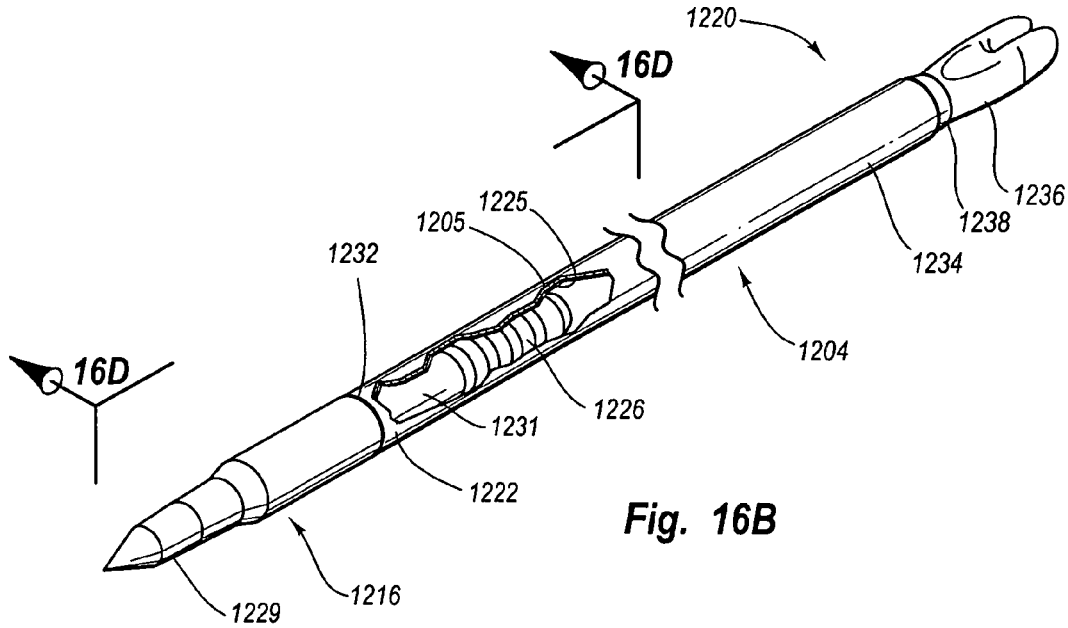
FIG. 16B is an assembled perspective view of the arrow system shown in FIG. 16A.
Figure 16C:
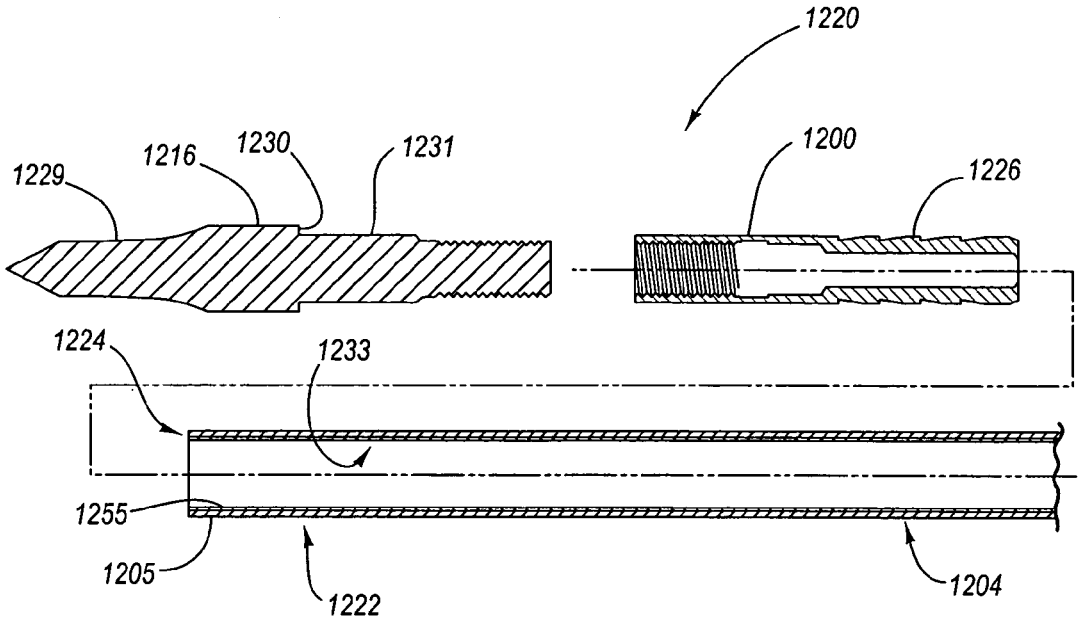
FIG. 16C is an exploded partial sectional side elevation view of an end of the arrow system shown in FIG. 16A.
Figure 16D:
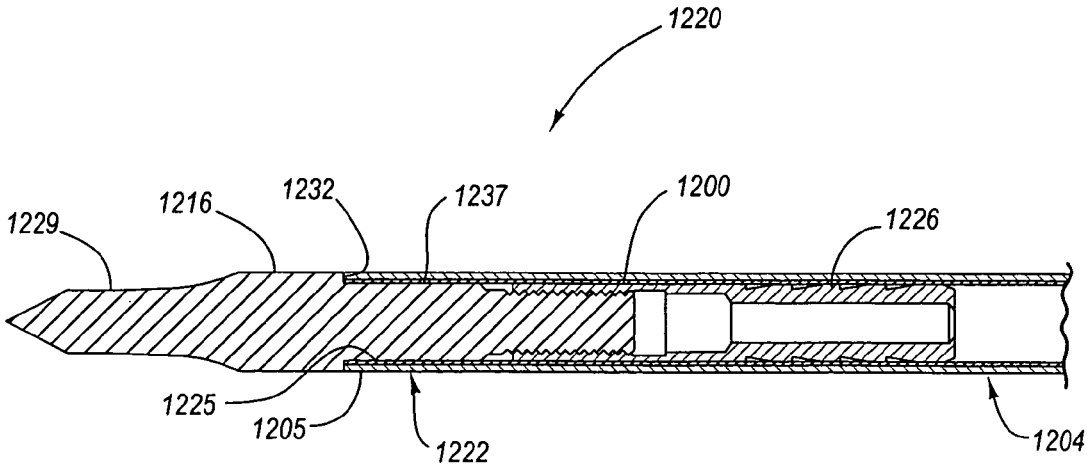
FIG. 16D is an assembled partial sectional side elevation view of the end of the arrow as shown in FIG. 16C.

Another embodiment of the invention is shown in FIGS. 16A–16D. According to FIGS. 16A–16D, an arrow 1220 is shown and includes a shaft 1204 and an insert 1200. The insert 1200 is receptive of a point 1216. The insert 1200 is advantageously sized to fit snugly completely within the shaft 1204 as shown in FIGS. 16B and 16D. Accordingly, the insert 1200 may have a substantially constant outside diameter (without regard to conventional glue grooves) sized to fit fully within an inside diameter of the shaft 1204.

The insert 1200 may include one or more ridges 1226 about its outer diameter, as shown in FIGS. 16A and 16B. The ridges 1226 do not, however, extend beyond the substantially constant outside diameter of the insert 1200 and thus do not prevent full insertion of the insert 1200 into the shaft 1204. The insert may include a through hole, as shown in FIGS. 16A and 16C, or may have a so-called blind hole in the back wall of the insert (not shown).

The shaft 1204 is an aluminum-carbon shaft and includes a metallic core such as aluminum core tube 1225 (FIGS. 16C–16D) having a front end portion 1222 and a front end wall 1224. The front end wall 1224 corresponds to the terminating end of shaft 1204. The front end portion 1222 corresponds to a point end, as opposed to a rear or nock end. Preferably, the inside diameter of aluminum core tube 1225 (FIGS. 16C–16D) is sized to receive the insert 1200. Insert 1200 is sized substantially the same as the insert 500 of FIG. 5A. The ID of the aluminum core tube 1225 (FIGS. 16C–16D) is approximately 0.200 inches according to some embodiments. In other embodiments, the ID of aluminum core tube 1225 (FIGS. 16C–16D) is approximately 0.204 inches.

The aluminum-carbon shaft 1204 also includes a layer of fiber reinforced polymer, such as carbon layer 1205 shown more clearly in FIGS. 16C–16D. Accordingly, the arrow 1220 shown in FIGS. 16A–16D may be commonly referred to as an "aluminum-carbon composite arrow" although the fiber reinforced polymer is not limited to carbon as the reinforcing fiber. The carbon layer 1205 may be filament wound about the aluminum core 1225, molded onto the aluminum core 1225, or otherwise disposed about the aluminum core 1225. According to some embodiments, the carbon layer 1205 has an OD of approximately 0.275 inches or less. In another embodiment, the carbon layer has an OD of 0.258 inches or less. However, the OD of the carbon layer 1205 may also be a standard size.

According to some embodiments, the ID of the aluminum core 1225 corresponds to a diameter completely receptive of the insert 1200. As shown in FIG. 16B, a rear end portion 1234 is receptive of a nock 1236. A nock adapting insert 1238 may be included between the shaft 1204 and the nock 1236. Although FIG. 16B shows such an insert, it is to be understood that any nock system, such as without limitation, direct fit nock systems (e.g., as shown in FIG. 1), UNI™ bushings with g-nock systems (e.g., as shown in FIG. 5B), and PIN nock systems with PIN nocks (e.g., as shown in FIG. 4B), may be used without departing from the scope of the present invention. In addition, a plurality of vanes or other fletching (not shown in the drawings) may be secured to the rear end portion 1234 of the shaft 1204.

As mentioned above, the insert 1200 is receptive of the point 1216. The point 1216 is preferably a standard size, commercially available point. The point 1216 includes a head 1229 and a shoulder 1230 where a relatively greater outside diameter of the point 1216 transitions to a shank 1231. According to principles described herein, the insert 1200 has no lip (e.g., element 118 in FIG. 1) and is inserted completely (i.e, at least flush with or below the end wall 1224 (FIG. 16C)) within the shaft 1204. Therefore, the shoulder 1230 of the point 1216 advantageously bears directly against the front end surface 1224 (FIG. 16C) of the shaft 1204 as shown in FIGS. 16B and 16D. The direct engagement between the shoulder 1230 and the end surface 1224 according to FIGS. 16B and 16D provides a first direct interface location 1232 (FIGS. 16B and 16D) between the end wall 1224 (FIG. 16C) of the shaft 1204 and the shoulder 1230 (FIG. 16C) of the point 1216 which facilitates a simpler, more precise alignment between the point and the arrow shaft.

The novel arrow system also provides a second interface location 1237 (FIG. 16D) between the shaft 1204 and the point 1216. Specifically, the outside surface of the shank 1231 (FIG. 16C) of the point 1216 bears directly against and the inside surface 1233 (FIG. 16C) of the aluminum core 1225. Accordingly, as shown in FIG. 16D, the present invention provides two sets of direct interfacing surfaces (interfaces 1232 and 1237) between the arrow shaft 1204 and the point 1216 to improve alignment. It is to be understood that while some aspects of the present invention are directed to hunting arrows only, this particular aspect of the present invention applies to all types of arrows, both hunting arrows and target arrows. As with the carbon arrows described above, the reduced diameter of the shaft 1204 results in better penetration than standard aluminum arrows.

While this invention has been described with reference to certain specific embodiments and examples, it will be recognized by those skilled in the art that many variations are possible without departing from the scope and spirit of this invention. The invention, as defined by the claims, is intended to cover all changes and modifications of the invention which do not depart from the spirit of the invention. The words "including" and "having," as used in the specification, including the claims, shall have the same meaning as the word "comprising."

What is claimed is:

1. An aluminum-carbon arrow, comprising:

a metallic core having a front end portion;

a fiber reinforced polymer layer disposed about the metallic core;

an insert receptive of a point, the insert being recessed and disposed completely within the front end portion.

2. An aluminum-carbon arrow according to claim 1 wherein the point comprises a shoulder and the shaft comprises a front end wall, and wherein the insert is seated at a depth within the shaft such that the shoulder of the point bears against the front end wall of the shaft when the point is fully engaged with the insert.

3. An aluminum-carbon arrow according to claim 1, wherein an outer diameter of the fiber reinforced polymer layer comprises a standard aluminum arrow size.

4. An aluminum-carbon arrow according to claim 1 wherein an outer diameter of the fiber reinforced polymer layer is less than or equal to approximately 0.275 inches.

5. An aluminum-carbon arrow according to claim 1 wherein an inner diameter of the metallic core is approximately 0.200 inches.

6. An aluminum-carbon arrow according to claim 1 wherein the metallic core comprises an aluminum tube.

7. An aluminum-carbon arrow according to claim 1 wherein the fiber reinforced polymer layer comprises carbon.

8. An arrow system, comprising:

an aluminum carbon composite arrow shaft having an outside diameter of 0.275 inches or less;

an insert receptive of a point, the insert being recessed and disposed completely within a front end portion of the carbon aluminum arrow shaft, wherein the point comprises a shoulder and the carbon aluminum arrow shaft comprises a front end wall; wherein the insert is seated at a depth within the arrow shaft such that the shoulder of the point bears against the end wall of the shaft when the point is fully engaged with the insert.

9. A method of making an aluminum-carbon arrow, comprising:

providing an aluminum core tube;

covering the aluminum core tube with a fiber reinforced composite;

positioning an insert in a recessed position completely disposed within the aluminum core tube.

10. A method of making an aluminum-carbon arrow according to claim 9, further comprising connecting a point to the insert.

11. A method of making an arrow according to claim 9, further comprising:

attaching a point to the insert;

bearing a shoulder of the point directly against a front end wall of the aluminum core tube.

* * * * *